United States Patent [19]

Johary

[11] Patent Number: 4,918,436

[45] Date of Patent: Apr. 17, 1990

[54] HIGH RESOLUTION GRAPHICS SYSTEM

[75] Inventor: Arun Johary, San Jose, Calif.

[73] Assignee: Chips and Technology, Inc., San Jose, Calif.

[21] Appl. No.: 76,099

[22] Filed: Jul. 21, 1987

Related U.S. Application Data

[63] Continuation-in-part of Ser. No. 56,847, Jun. 1, 1987, abandoned.

[51] Int. Cl.[4] ..... G09G 1/28

[52] U.S. Cl. ..... 340/799; 340/703; 340/744

[58] Field of Search ..... 340/728, 701, 702, 703, 340/747, 744, 731, 799, 798, 800, 801; 358/140; 364/521

[56] References Cited

U.S. PATENT DOCUMENTS 4,250,502 2/1981 Klauch et al. ..... 340/728
4,673,929 6/1987 Nelson et al. ..... 340/703

OTHER PUBLICATIONS

Stewart Alsop; *The Enhanced Graphics Standard Comes of Age; PC Magazine; pp. 141-143; Aug., 1986.*
Charles Petzold; *Achieving the Standard: 12 EGA Boards;* PC Magazine; pp. 145-182; Aug., 1986.
Charles Petzold; *Exploring the EGA,* Part 1; PC Magazine; pp. 367-384; Sep. 16, 1986.
Charles Petzold; *Exploring the EGA, Part 2;* PC Magazine; pp. 287-313; Aug., 1986.
"IBM Enhanced Graphics Adapter", IBM, Aug. 2, 1984, pp. 1-75.
"82C435 Enhanced Graphics Controller, 82A436 Bus Interface", Chips and Technologies, Jan. 1987, pp. 1-30.
Stewart Alsop, "The Enhanced Graphics Standard Comes of Age", PC Magazine, pp. 141-143, Aug. 1980.
Petzold, "Achieving the Standard: 12 EGA Boards"; PC Magazine, pp. 145-182, Aug. 1986.
Petzold, "Exploring the EGA, Part 1"; PC Magazine, Sep. 1986.
Petzold, "Exploring the EGA, Part 2"; PC Magazine, p. 3, Aug. 1988.

*Primary Examiner*—Donald J. Yusko
*Assistant Examiner*—Alvin Oberley
*Attorney, Agent, or Firm*—Townsend and Townsend

[57] ABSTRACT

A video graphics controller circuit for a personal computers includes a standard, EGA-compatible graphics adapter and a high-resolution companion module. A method is disclosed for configuring the graphics adapter is to generate 2 pixels in parallel in each clock cycle. The companion module serializes the pixels to generate a serial stream of pixels at twice the frequency of the graphics adapter. The companion module can also be configured as a video line driver so that the graphics controller circuit can also run software in standard video modes.

13 Claims, 15 Drawing Sheets

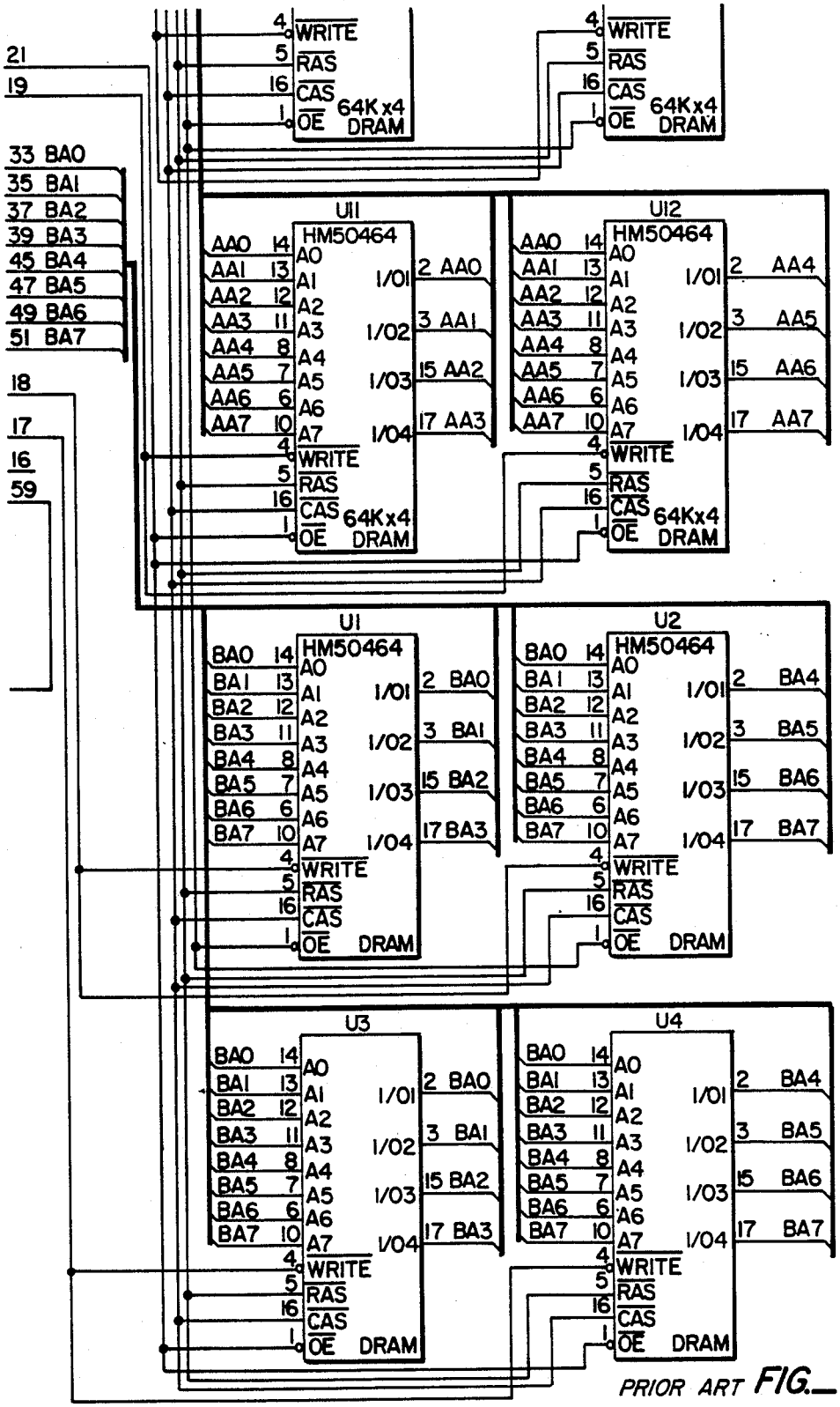
PRIOR ART FIG._4F.

| REFERENCE | COMPONENT |
|---|---|
| U1-U4, U9-U12 | HM50464 |
| U5-U8, U14-U16 | SPARE |
| U17 | 82C435 |
| U18 | 27513 (OR 27128) |
| U19, U20, U23 | 74LS244 |
| U21 | CRYSTAL-16.257 MHz |
| U22 | 74LS153 |
| RP1, RP2 | RESISTOR PACK-SIP COMMON VCC- 10K |
| RP3, RP4 | RESISTOR PACK-SIP 4x22 OHM |
| R1, R4 | RESISTOR - 10K |
| R3 | RESISTOR - 2K |
| R2, R5, R6 | RESISTOR - 51 OHM |
| SWITCH | 5 POSITION DIP SWITCH |
| CONNECTOR J1 | 1x3 BERG |
| CONNECTOR J2 | RCA VIDEO JACKS |
| CONNECTOR J3 | 9 PIN D-TYPE |
| CONNECTOR J4 | 32 PIN DUAL ROW |
| CONNECTOR J5 | 1x6 BERG |
| U13 | CRYSTAL - 25 MHz |

NOTE: DRAM CONTROL LINES MAY REQUIRE 10 OHM-100 OHM DAMPING RESISTORS DEPENDING ON DESIGN LAYOUT. (AA0-7, BA0-7, $\overline{WED-3}$, $\overline{OE13}$, $\overline{OE02}$, $\overline{RAS}$, $\overline{CAS}$)

FIG._4G. PRIOR ART

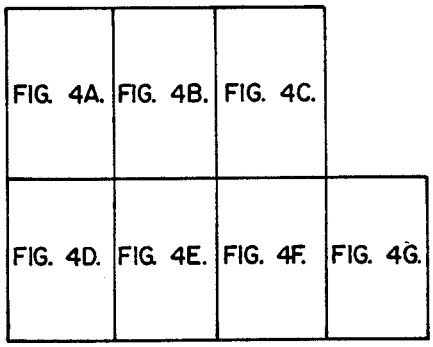

FIG._4.

HIGH RESOLUTION GRAPHICS SYSTEM

CROSS-REFERENCE TO RELATED APPLICATION

This application is a continuation-in-part of my copending U.S. patent application Ser. No. 056847 filed June 1, 1987, abandoned.

BACKGROUND OF THE INVENTION

This invention relates generally to video display controller systems, and, more particularly, it relates to a high resolution graphics display controller system for personal computers.

As the utility and popularity of personal computers has increased, the demand for high quality graphics displays has also increased. When the IBM personal computer (IBM PC) was introduced in 1981, it only produced an 80 character by 25 line monochrome or color text display. A Color Graphics Adapter (CGA) could be added to the IBM PC to generate a 4-color graphics display at a maximum resolution of 320 horizontal picture elements (pixels) by 200 lines (320×200), or a 2-color graphics display of 640×200. In 1984, the Enhanced Graphics Adapter (EGA) was introduced for use with the IBM PC and compatible computers. Depending on the type fo monitor and the amount of video display memory used with the EGA, graphics displays of up to 16 colors can be produced with maximum resolution of 640×350.

The EGA was designed to be "backward-compatible", i.e., it can be configured to work properly with software which was written for the CGA or monochrome adapters, at the lower resolutions generated by those adapters. The EGA has several programmable registers which can be programmed with predetermined combinations of values to configure the EGA in the appropriate mode for the software, the monitor, and the amount of display memory available.

Presently, several companies are marketing video adapters compatible with IBM's EGA, and the EGA has become a de facto standard for display control in IBM and IBM-compatible personal computers. (See "The Enhanced Graphics Standard Comes of Age" PC Magazine Vol. 5, No. 14, August 1986). A standard is important because it allows software writers to focus on creating a single version (or, at least a reasonably limited number of versions) of their software. Consequently, a large body of standardized software is available to consumers.

Monitors are now available for displaying even higher resolution displays than the 640×350 graphics produced by current EGAs. There are circuits and computers available which produce higher resolutions. It is desirable, however, to provide higher resolution graphics capability without sacrificing compatibility with the large body of existing software. Hundreds of programs are available for IBM PCs and compatible computers in CGA and EGA modes, and many consumers already own these versions of their favorite programs. Furthermore, it is desirable to take advantage of the low cost of the EGA resulting from its mass production and very high levels of integration. However, higher resolution graphics displays require a graphics adapter circuit which can operate at higher speeds than is currently possible with EGA-compatible adapters.

SUMMARY OF THE INVENTION

The invention provides a method and apparatus for providing an increased resolution graphics display using currently available graphics adapters. According to one aspect of the invention, a new method of configuring the graphics adapter causes it to generate 2 picture elements (pixels) per master clock cycle, as compared to the previous maximum of one pixel per cycle. Alternate memory planes are chained together to increase the processor's address window. The display serializers (shift registers) are formatted such that all of the bits which define adjacent pixels are in different shift registers, so that they can be shifted out together in one cycle. According to another aspect of the invention, a companion module is provided for converting the two pixels generated in parallel by the graphics adapter in each graphics adapter clock (dot clock) cycle to a serial stream of pixels at twice the frequency of the dot clock. The effect is to generate pixels at twice the maximum frequency at which the graphics adapter can operate. The companion module can be configured in various states to function as a serializer and/or a video line driver, or to assume high-impedance states on its outputs.

Because a standard graphics adapter circuit can be utilized, and because the companion module can be configured as a video line driver, all software written for CGA or EGA modes will continue to work properly. Moreover, the new, higher resolution mode works with software written for one of the older EGA modes with only minor modifications to that software.

DESCRIPTION OF PREFERRED EMBODIMENT

Figure 1:
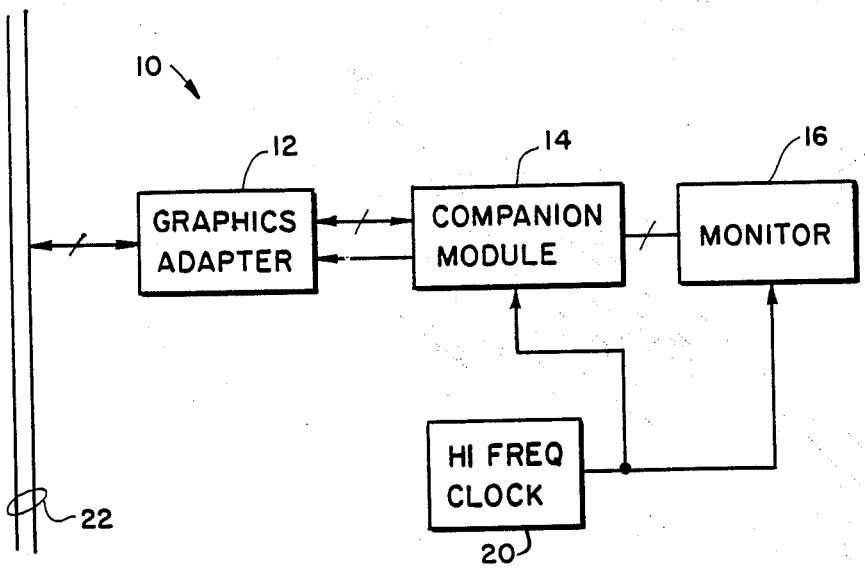
FIG. 1 is a block diagram of a display system for practicing the invention.

FIG. 1 is a block diagram of a display system 10 for practicing the invention. Display system 10 comprises a graphics adapter 12, a high resolution companion module 14, a display monitor 16, and a high frequency clock 20. Clock 20 is divided by 2 by companion module 14 and the resulting clock signal is coupled to graphics adapter 12 where it is used as the dot clock. A system bus 22 couples data, address, and control signals from the computer's central processing unit (CPU) (not shown) to graphics adapter 12. The signals from the CPU configure the internal state of graphics adapter 12, including the video memory. Graphics adapter 12 generates two pixels (of two bits each in this embodiment) per dot clock cycle. These two pixels are transmitted in parallel to high resolution companion module 14. Companion module 14 serializes the two pixels and transmits them to monitor 16 at the rate of one pixel per high frequency clock cycle. High frequency clock 20 is also input to monitor 16 for clocking in pixels. Monitor 16 thus receives pixels at a rate which is twice the dot clock frequency at which graphics adapter 12 is operating. The resolution of the display on monitor 16 is twice the maximum resolution which is normally produced by the graphics adapter at its maximum clock rate. For example, a graphics adapter capable of operating at a maximum frequency of 30 megahertz can effectively generate pixels at the rate of 60 megahertz. At this frequency, the maximum resolution for 4-color graphics can be increased, for example, to at least 1280×350; with 256 Kb of display memory, any arrangement of up to 1,024,000 pixels may be generated.

Graphics adapter 12 of FIG. 1 is an IBM EGA compatible adapter. The term "EGA-Compatible" has a specific meaning well-known in the art. An EGA compatible adapter is one that interacts with the software and hardware to produce the same results as the EGA. Specifically, an EGA-compatible adapter has at least the functionality and programmability described in the publicly available IBM publication, "IBM Enhanced Graphics Adapter", August 2, 1984, EGA adapters are generally provided as boards which can be inserted in the computer's expansion slots, but they can be built into the computer's circuitry.

Companion module 14 performs two functions: (1) it serializes the 2 pixels received in parallel from graphics adapter 12 and (2) it acts as a video line driver for interfacing the video signals from graphics adapter 12 to the monitor. When the high resolution mode is not in effect, it can act as a simple video line driver. Companion module 14 can be substituted for the video line driver in the graphics adapter. Alternatively, companion module 14 can be put on a "daughter board" along with a high speed clock source, and coupled to the feature connector on the EGA board.

Figure 2:
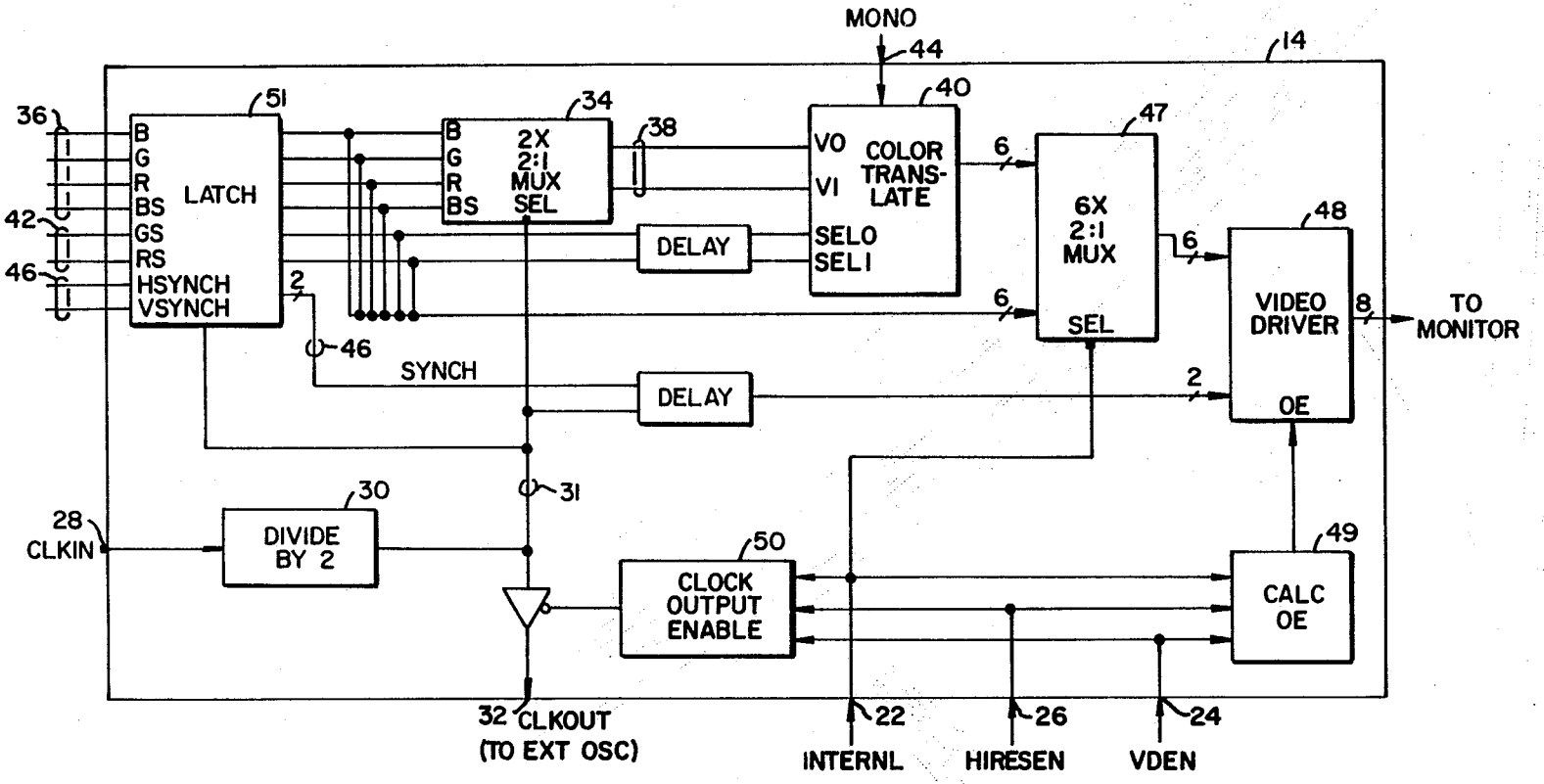
FIG. 2 is a block diagram of the high resolution companion module of FIG. 1.
Figure 4A:
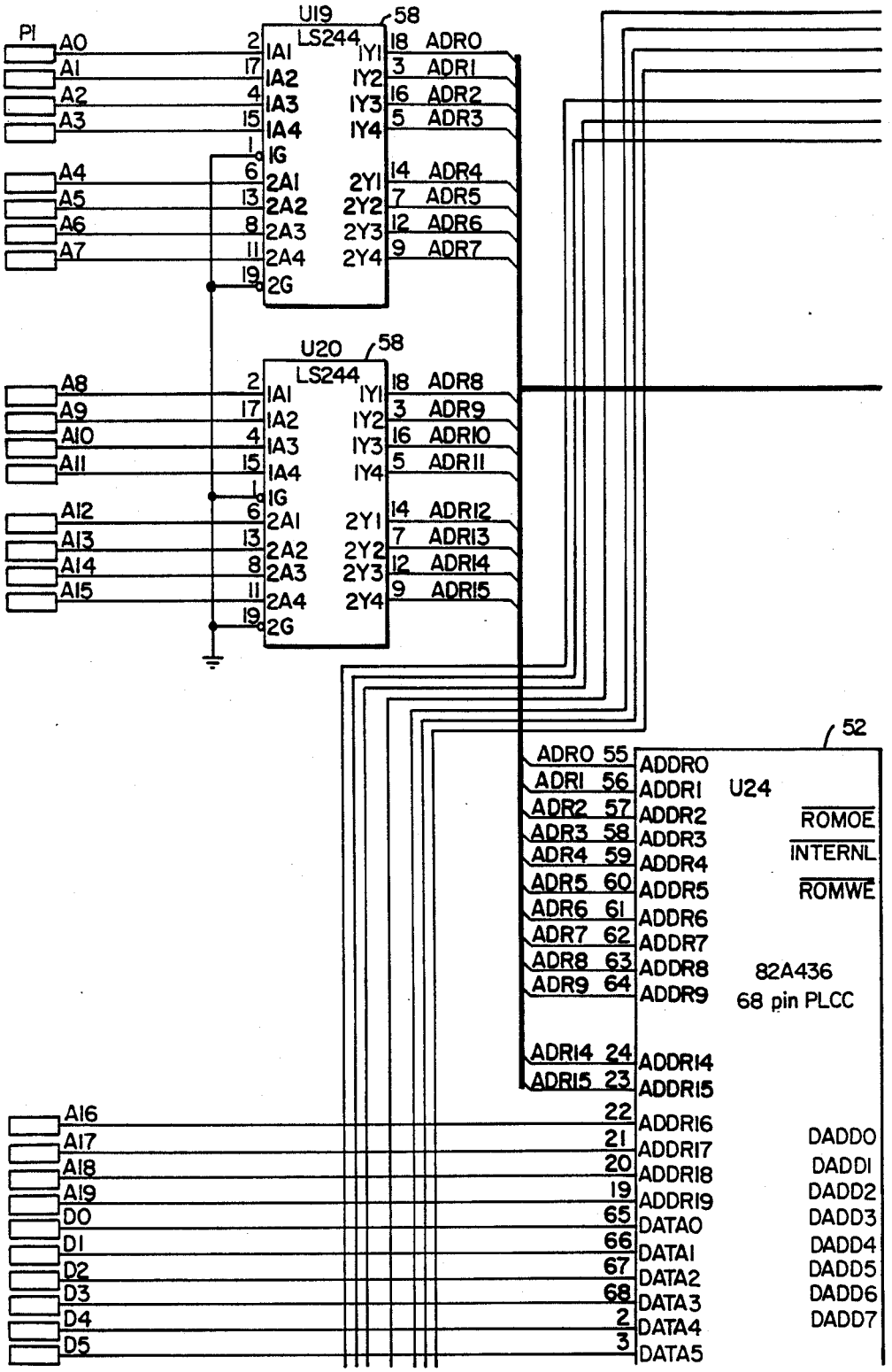
FIG. 4A. PRIOR ART
FIG. 4 is a detailed schematic of the graphics adapter circuit.
Figure 4B:
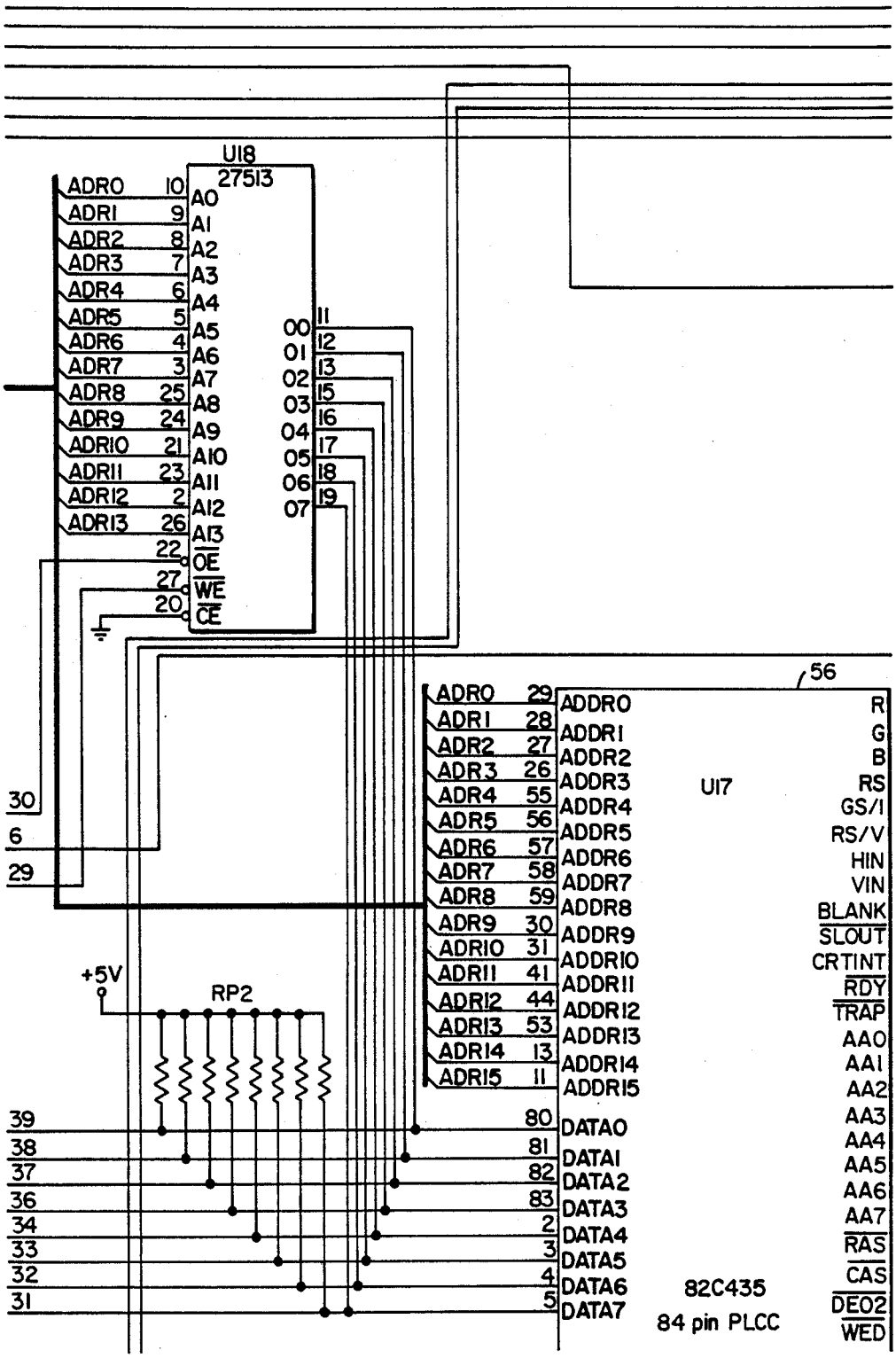
FIG. 4B. PRIOR ART
Figure 4C:
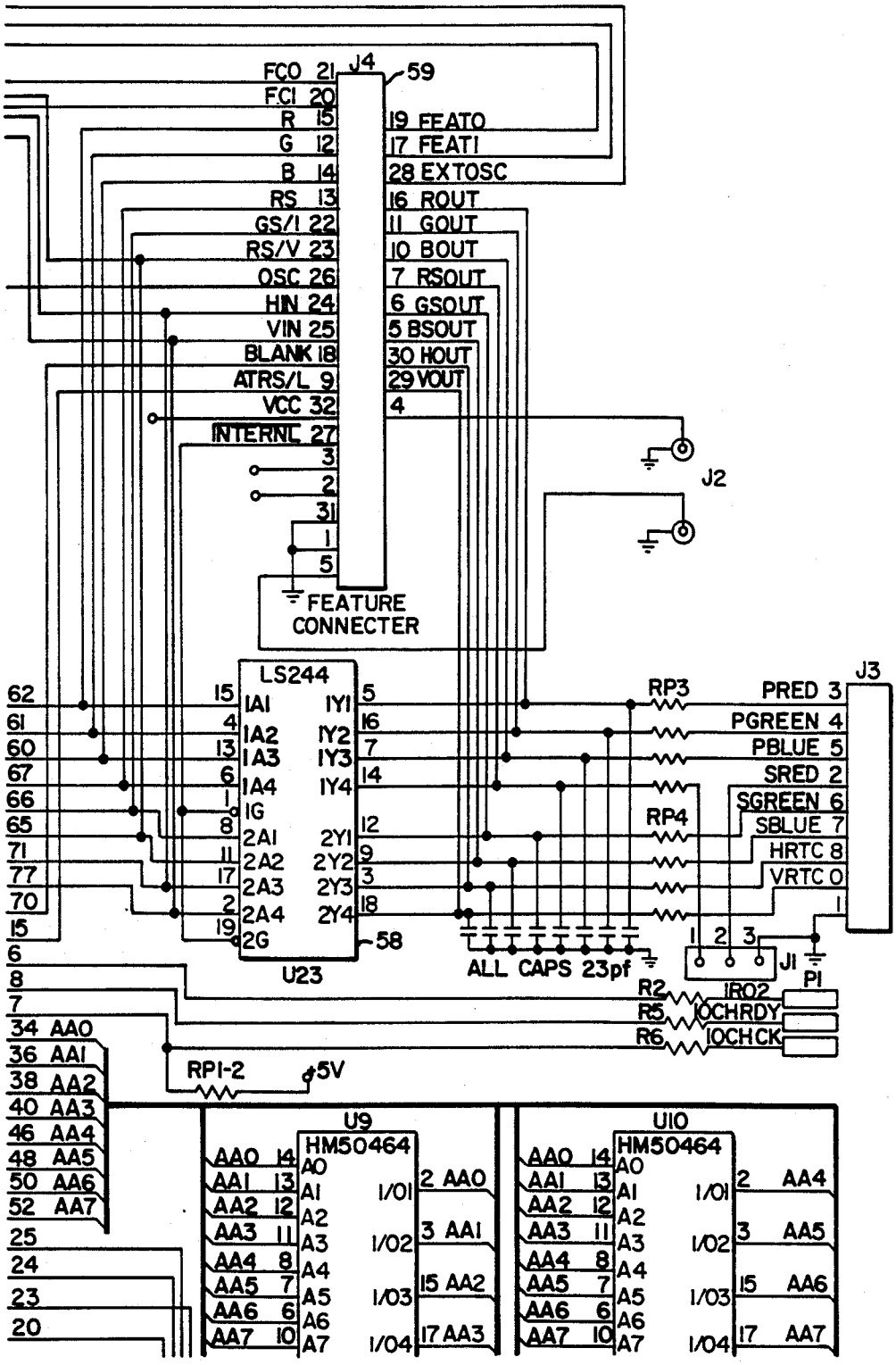
FIG. 4C. PRIOR ART
Figure 4D:
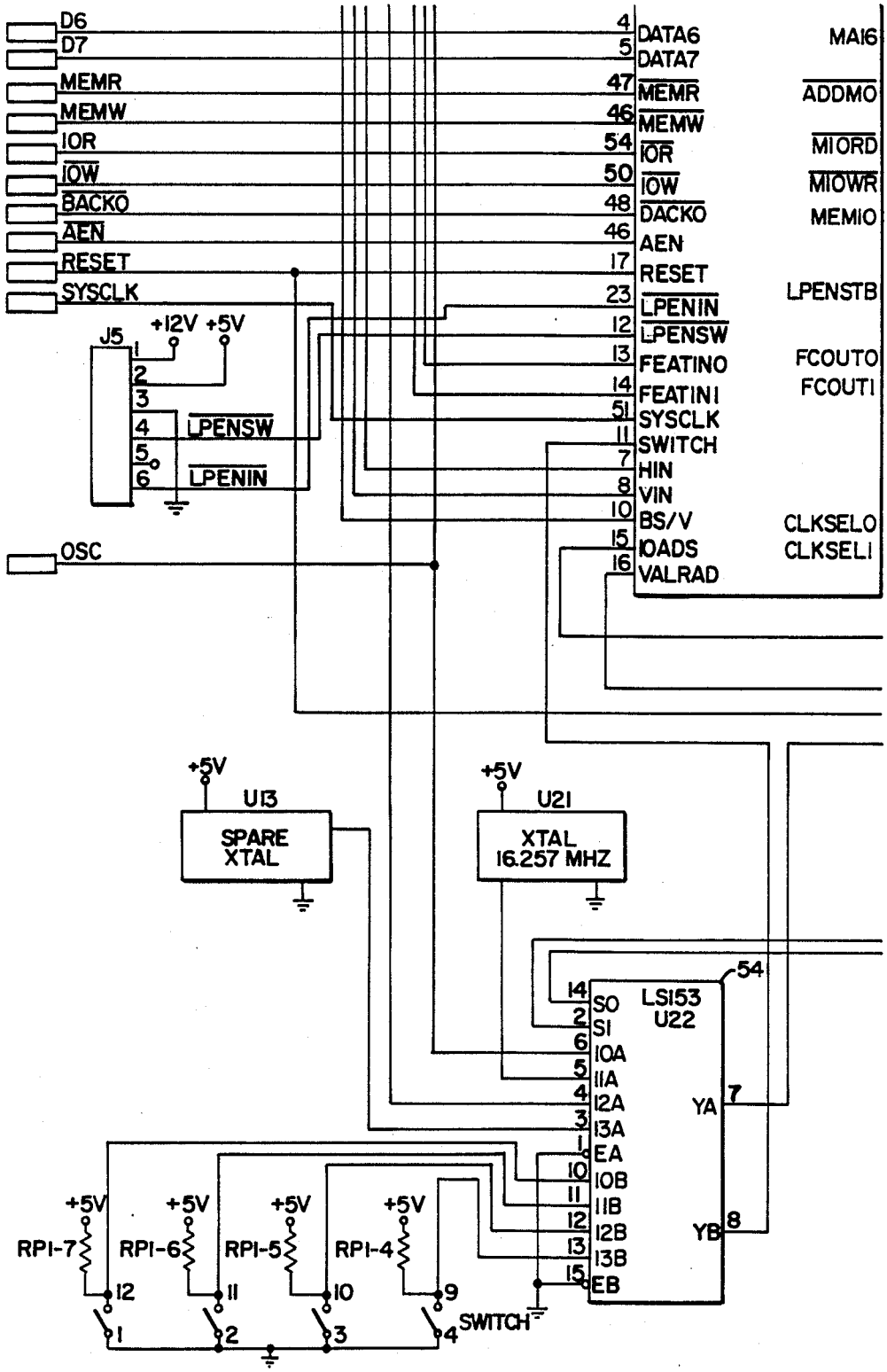
FIG. 4D. PRIOR ART
Figure 4E:
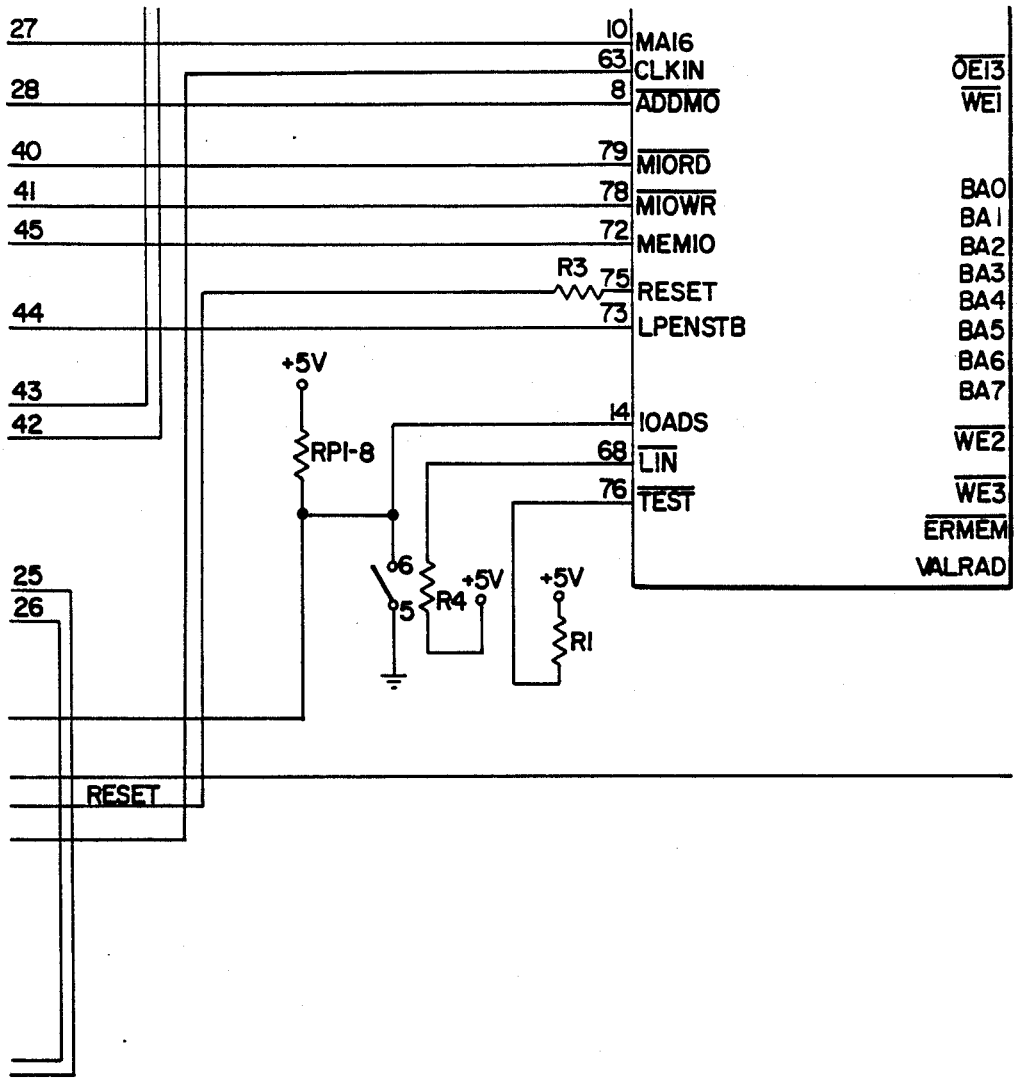
FIG. 4E. PRIOR ART

Referring to FIG. 2, a block diagram of companion module 14 of FIG. 1 is shown. Input lines INTERNL 22. VDEN 24, and HIRESEN 26 are used to properly configure the companion module. Table I shows the 6 valid combinations of these three inputs.

TABLE I

| | HIRESEN | VDEN | INTERNL | |
|---|---|---|---|---|
| (1) | H | L | L | EGA drives |
| (2) | H | L | H | HIRES mode |
| (3) | L | H | L | Driver only |
| (4) | L | H | H | FC in use |
| (5) | H | H | L | Driver only |
| (6) | H | H | H | HIRES mode |

The first two cases (1,2) are used when the companion module is on a daughter board coupled to the feature connector. VDEN is pulled low to disable the "video line driver only" function. HIRESEN is pulled high to enable the high resolution mode. The VDEN and HIRESEN signals are controlled by a jumper block. The INTERNL signal is under the control of the software which programs the EGA (described below with reference to programming of miscellaneous output register). If INTERNL is low (case 1), the companion module outputs are tristated (high impedance) and the EGA directly drives the monitor. When INTERNL is high, the high resolution mode is in effect and the companion module serializes the pixels and drives the monitor. The outputs of the video line driver on the main EGA board are tristated by the high INTERNL signal.

The last four cases (3–6) are used when the companion module replaces the video line driver on the EGA board. The VDEN signal is high in all four cases, enabling the video line driver function. In cases 3 and 4, HIRESEN is low, allowing the feature connector to be used for some other purpose. When INTERNL is low (case 3), the companion module functions only as a video line driver and its outputs follow its inputs. When INTERNL is high (case 4), the companion module outputs are tristated (high impedance). (Daughter board attached to feature connector drives monitor.) In cases 5 and 6, HIRESEN is high, and the feature connector cannot be used. When INTERNL is low (case 5), the companion module functions as a video line driver and its outputs follow its inputs. When INTERNL is high (case 6), the high resolution mode is in effect and the companion module serializes the pixels and drives the monitor.

Returning to FIG. 2, high frequency clock 20 (up to 60 mhz) is input to the companion module at CLKIN 28. High frequency clock 20 is coupled to frequency divider 30. Frequency divider 30 divides the output of high-frequency clock 20 by two to generate (on line 31) a square wave of one-half the frequency of the high-frequency clock. This slower clock is output at CLKOUT 32 for input to the EGA graphics adapter (where the leading or trailing edge is used as the dot clock), and it is also coupled to the select input of multiplexer (mux) 34 and to latch 51. The 4 parallel bits 36 representing the two pixels per cycle from the EGA are coupled to mux 34 which serializes the pixels. When the square wave on line 31 is high (one half of a dot clock cycle), multiplexer 34 selects one of the two pixels (two of the 4 mux inputs) for output on lines 38; when the clock is low (other half of a dot clock cycle) it selects the other pixels (the other two input lines). The selected pixel bits are coupled to a color translator 40. A two-bit color select signal from the EGA is received at companion module inputs 42 and coupled directly to color translator 40. Color translator 40 uses this color select signal to select one of four sets of four colors each, and translates each pixel into one of the four colors in the selected color set. If the signal received at the MONO input 44 is high, the video outputs are configured for a monochrome monitor. If this signal is low, the outputs are configured for a color monitor. The translator outputs are coupled to multiplexer 47, which, in response to the INTERNL signal, selects either the color translator outputs (INTERNL high) or the unmodified) color inputs 36, 42. The selected outputs from mux 47 are coupled to video line driver 48, which generates output signals in the appropriate form for driving the display monitor. Vertical and horizontal synchronization signals 46 are passed through the video driver to the monitor.

In this embodiment, the video outputs from companion module 14 are suitable for use with TTL digital interface monitors, such as those monitors used with the IBM PC and compatible computers.

The color selections provided by color translator 40 are shown in Table II. The logic equations for the companion module, including color translator 40, are given in Table III. The OE equation (Output Enable) of Table III is used by OE calculator 49 for enabling the outputs of video driver 48. In cases 1 and 4 of Table I, OE Calculator 49 disables video line driver 48, causing the outputs of video line driver 48 to assume a high-impedance state. The CE equation (Clock Enable) of Table III is used by Clock Output Enable 50 for enabling output Clkout 32. In cases 1, 3, and 4 of Table I, CLKOUT is high-impedance. In cases 1 and 4, all companion chip outputs are high-impedance; in case 3, CLKOUT is high-impedance so that another external clock may be supplied through the feature connector.

TABLE II

| VIDIN5-6 | COLOR0 | COLOR1 | COLOR2 | COLOR3 |
|---|---|---|---|---|
| | | MONO = 0 | | |
| 00 | Black | White | Grey | Br. White |
| 01 | Black | Cyan | Red | White |
| 10 | Black | Green | Red | Yellow |
| 11 | Black | Cyan | Magenta | White |
| | | MONO = 1 | | |
| 00 | Black | White | Black | Br. White |
| 01 | Black | White | Black | Br. White |
| 10 | Black | White | Black | Br. White |
| 11 | Black | White | Black | Br. White |

TABLE III

```
CLK =        CLKIN/2;
CE =         !HIRESEN# (!INTERNL & HIRESEN & !VDEN
OE =         (!INTERNL & VDEN) # (INTERNL & HIRESEN);
NORMAL =     !INTERNAL & VDEN;
ACCEL =      INTERNL & HIRESEN;
VX0 =        Bin & !CLK # Rin & CLK ;
VX1 =        Gin & !CLK # BSin & CLK ;
C0 =         !RSin & !GSin;   /*Color Set 0*/
C1 =         !RSin & GSin;    /*Color Set 1*/
C2 =         RSin & !GSin;    /*Color Set 2*/
C3 =         RSin & GSin;     /*Color Set 3*/
P0 =         !VX1 & !VX0;     /*Color Code 0*/
P1 =         !VX1 & VX0;      /*Color Code 1*/
P2 =         VX1 & !VX0;      /*Color Code 2*/
P3         = VX1 & VX0;/*Color Code 3*/
Bout       = ((((C0 # C2 # C3) & (P1 # P3)) #
             (C0 & P2)) & !MONO) & ACCEL # (Bin & NORMAL);
Gout       = ((P1 # P3) & !MONO) & ACCEL # (Gin & NORMAL) ;
Rout       = ((((C0 # C1 # C2) & (P2 # P3)) # (C3 &
             (P1 # P3))) & !MONO) & ACCEL # (Rin & NORMAL);
BSout      = ((((C3 & (P2 # P3))) & !MONO) #
             ((P1 # P3) & MONO)) & ACCEL # (BSin & NORMAL);
GSout      = ((((C3 & (P2 # P3))) & !MONO) #
             ((P2 # P3) & MONO)) & ACCEL #GSin & NORMAL);
RSout      = (((C3 & (P2 # P3))) & !MONO) & ACCEL #
             (RSin & NORMAL);
```

LEGEND
! = not
# = or
& = and

Figure 3:
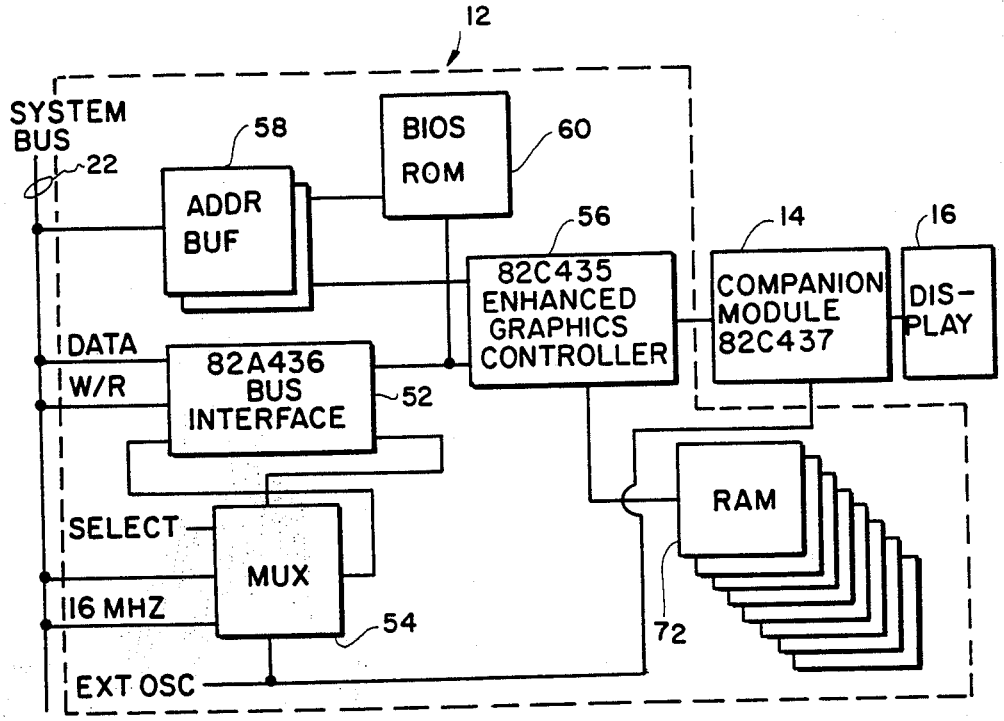
FIG. 3 is a block diagram of the graphics adapter of FIG. 1.

Referring to FIG. 3, details of graphics adapter 12 of FIG. 1 are shown. A bus interface module 52 provides bus interface, memory select and I/O select logic functions. Bus interface 52 of this embodiment is a single integrated circuit chip 82A436 available from Chips and Technologies, Inc., of Milpitas, California. A multiplexer 54 is coupled to bus interface module 52 for selecting an internal or external clock source (ext. osc). An enhanced graphics controller module 56 is coupled to address buffer 58, bus interface 52, and to video display memory 72 for generating the display signals. Enhanced graphics controller module 56 is a single integrated circuit chip 82C435 also available from Chips and Technologies, Inc. Enhanced graphics controller module 56 is used for implementing an EGA compatible graphics adapter for IBM and IBM-compatible personal computers. The data sheet for the Chips and Technologies Enhanced Graphics Controller chip and the Bus Interface chip is publicly available from Chips and Technologies, Inc.

Figure 5:
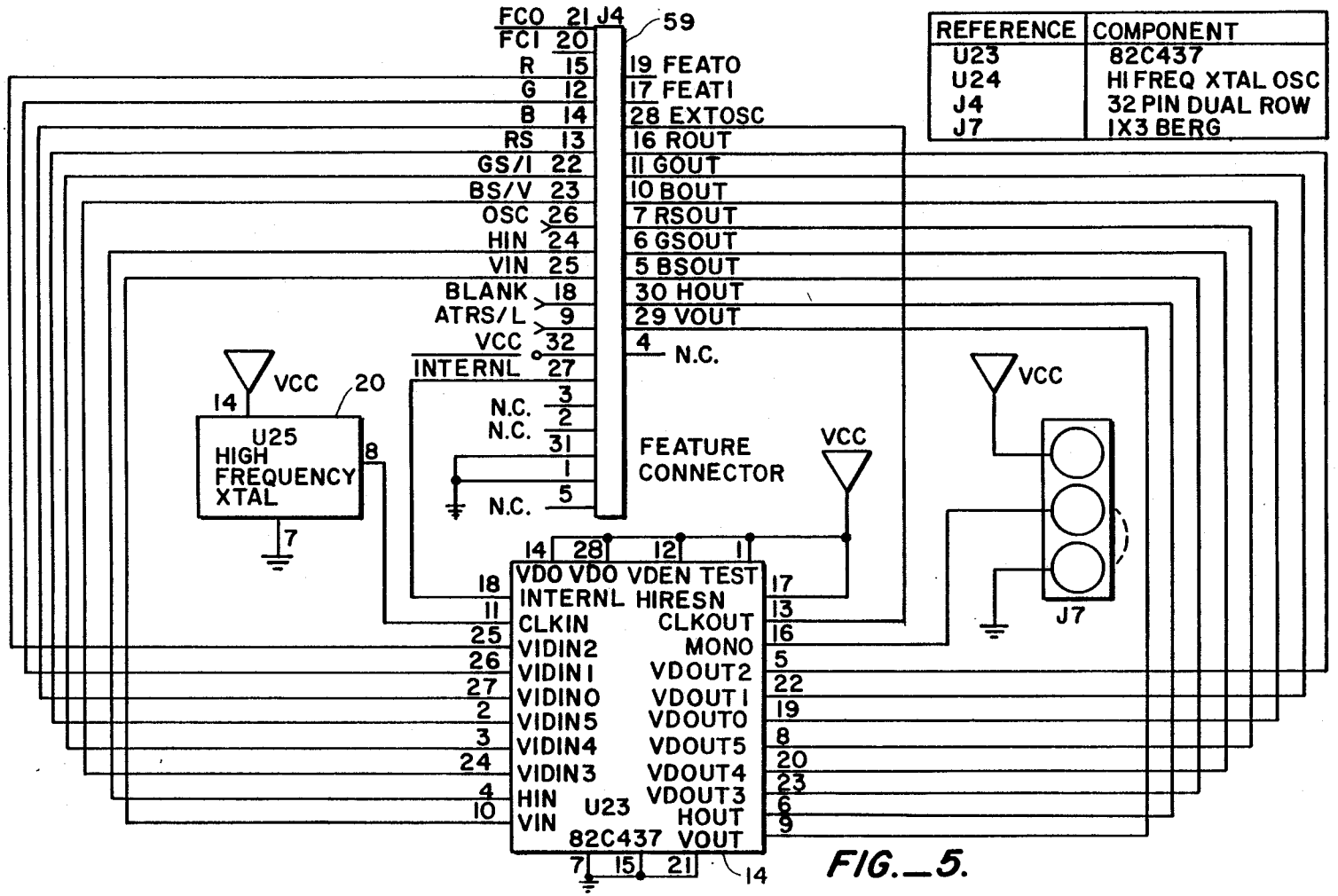
FIG. 5 is a schematic diagram of a daughter board for implementing the companion module of FIG. 2.

FIG. 4 is a detailed schematic for implementing the circuit of FIG. 3. The companion module can replace video line driver 58, which is a 74LS244 tri-state buffer. Alternatively, a daughter board with a high frequency clock and a companion module can be coupled to feature connector 59. A schematic of a daughter board containing companion module 14, clock 20, and connections to feature connector 59, is shown in FIG. 5.

Figure 6:
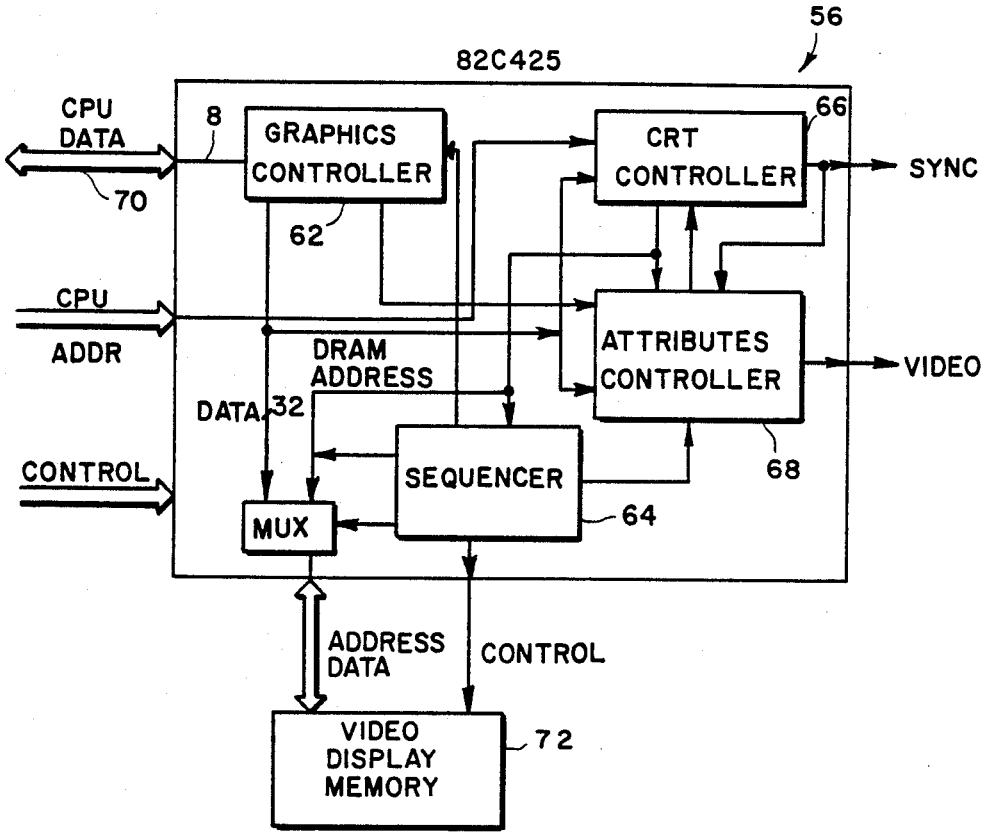
PRIOR ART FIG. 6.
FIG. 6 is a block diagram of the Enhanced Graphics Controller module of FIG. 3.

The general architecture and functionality of Enhanced graphics controller module 56 will now be described. Referring to FIG. 6, enhanced graphics controller 56 comprises four primary modules: graphics controller 62, sequencer 64, attributes controller 66, and CRT controller 68. Graphics controller 62 interfaces the eight bit CPU data bus 70 to display memory 72. It supports different types of pixel mappings for read and write operations. Graphics controller 62 is also responsible for directing data from display memory 72 to attributes controller 68. Attributes controller 68 provides a color palette and formats data from display memory 72 for display on the monitor.

TABLE IV

External Registers

| Register | | | Mode of Operation | | | | | | | | | | | | | | | | | | |
|---|---|---|---|---|---|---|---|---|---|---|---|---|---|---|---|---|---|---|---|---|---|
| Name | Part | Index | 0 | 1 | 2 | 3 | 4 | 5 | 6 | 7 | D | E | F | 10 | F** | 10** | 0* | 1* | 2* | 3* | |
| Miscellaneous | 3C2 | — | 23 | 23 | 23 | 23 | 23 | 23 | 23 | A6 | 23 | 23 | A2 | A7 | A2 | A7 | A7 | A7 | A7 | A7 | BB |
| Feature Cntrl | 37A | — | 00 | 00 | 00 | 00 | 00 | 00 | 00 | 00 | 00 | 00 | 00 | 00 | 00 | 00 | 00 | 00 | 00 | 00 | 00 |
| Input Stat 0 | 3C2 | — | — | — | — | — | — | — | — | — | — | — | — | — | — | — | — | — | — | — | |
| Input Stat 1 | 37A | — | — | — | — | — | — | — | — | — | — | — | — | — | — | — | — | — | — | — | |

? = B in monochrome modes
? = D in color modes
*Values for these modes when the IBM Enhanced Color Display is attached
**Values for these modes when greater than 64K Graphics Memory is installed

Sequencer Registers

| Register | | | Mode of Operation | | | | | | | | | | | | | | | | | | |
|---|---|---|---|---|---|---|---|---|---|---|---|---|---|---|---|---|---|---|---|---|---|
| Name | Part | Index | 0 | 1 | 2 | 3 | 4 | 5 | 6 | 7 | D | E | F | 10 | F** | 10** | 0* | 1* | 2* | 3* | |
| Seq Address | 3C4 | — | — | — | — | — | — | — | — | — | — | — | — | — | — | — | — | — | — | — | |
| Reset | 3C5 | 00 | 03 | 03 | 03 | 03 | 03 | 03 | 03 | 03 | 03 | 03 | 03 | 03 | 03 | 03 | 03 | 03 | 03 | 03 | 03 |
| Clock Mode | 3C5 | 01 | 0B | 0B | 01 | 01 | 0B | 0B | 01 | 00 | 0B | 01 | 05 | 05 | 01 | 01 | 0B | 0B | 01 | 01 | 01 |
| Map Mask | 3C5 | 02 | 03 | 03 | 03 | 03 | 03 | 03 | 01 | 03 | 0F | 0F | 0F | 0F | 0F | 0F | 03 | 03 | 03 | 03 | 0F |
| Char Gen Sel | 3C5 | 03 | 00 | 00 | 00 | 00 | 00 | 00 | 00 | 00 | 00 | 00 | 00 | 00 | 00 | 00 | 00 | 00 | 00 | 00 | 00 |
| Memory Mode | 3C5 | 04 | 03 | 03 | 03 | 03 | 02 | 02 | 06 | 03 | 06 | 06 | 00 | 00 | 06 | 06 | 03 | 03 | 03 | 03 | 02 |

*Values for these modes when the IBM Enhanced Color Display is attached
**Values for these modes when greater than 64K Graphics Memory is installed

Graphics SI Registers

| Register | | | Mode of Operation | | | | | | | | | | | | | | | | | | |
|---|---|---|---|---|---|---|---|---|---|---|---|---|---|---|---|---|---|---|---|---|---|
| Name | Part | Index | 0 | 1 | 2 | 3 | 4 | 5 | 6 | 7 | D | E | F | 10 | F** | 10** | 0* | 1* | 2* | 3* | |
| Grphx I Pos | 3CC | — | 00 | 00 | 00 | 00 | 00 | 00 | 00 | 00 | 00 | 00 | 00 | 00 | 00 | 00 | 00 | 00 | 00 | 00 | 00 |
| Grphx II Pos | 3CA | — | 01 | 01 | 01 | 01 | 01 | 01 | 01 | 01 | 01 | 01 | 01 | 01 | 01 | 01 | 01 | 01 | 01 | 01 | 01 |
| Grphx III AD | 3CE | — | — | — | — | — | — | — | — | — | — | — | — | — | — | — | — | — | — | — | |
| Set Reset | 3CF | 00 | 00 | 00 | 00 | 00 | 00 | 00 | 00 | 00 | 00 | 00 | 00 | 00 | 00 | 00 | 00 | 00 | 00 | 00 | 00 |
| Enable S/R | 3CF | 01 | 00 | 00 | 00 | 00 | 00 | 00 | 00 | 00 | 00 | 00 | 00 | 00 | 00 | 00 | 00 | 00 | 00 | 00 | 00 |
| Color Compare | 3CF | 02 | 00 | 00 | 00 | 00 | 00 | 00 | 00 | 00 | 00 | 00 | 00 | 00 | 00 | 00 | 00 | 00 | 00 | 00 | 00 |
| Data Rotate | 3CF | 03 | 00 | 00 | 00 | 00 | 00 | 00 | 00 | 00 | 00 | 00 | 00 | 00 | 00 | 00 | 00 | 00 | 00 | 00 | 00 |
| Read Map Sel | 3CF | 04 | 00 | 00 | 00 | 00 | 00 | 00 | 00 | 00 | 00 | 00 | 00 | 00 | 00 | 00 | 00 | 00 | 00 | 00 | 00 |
| Mode Register | 3CF | 05 | 10 | 10 | 10 | 10 | 30 | 30 | 00 | 10 | 00 | 00 | 10 | 10 | 00 | 00 | 10 | 10 | 10 | 10 | 30 |
| Miscellaneous | 3CF | 06 | 0E | 0E | 0E | 0E | 0F | 0F | 0D | 0A | 05 | 05 | 07 | 07 | 05 | 05 | 0E | 0E | 0E | 0E | 03 |
| Color No Care | 3CF | 07 | 00 | 00 | 00 | 00 | 00 | 00 | 00 | 00 | 0F | 0F | 0F | 0F | 0F | 0F | 00 | 00 | 00 | 00 | OF |
| Bit Mask | 3CF | 08 | FF | FF | FF | FF | FF | FF | FF | FF | FF | FF | FF | FF | FF | FF | FF | FF | FF | FF | FF |

*Values for these modes when the IBM Enhanced Color Display is attached
*Values for these modes when greater than 64K Graphics Memory is installed

CRT Controller Registers (1 of 2)

| Name | Part | Index | 0 | 1 | 2 | 3 | 4 | 5 | 6 | 7 | D | E | F | 10 | F* | 10* | 0* | 1* | 2* | 3* | |
|---|---|---|---|---|---|---|---|---|---|---|---|---|---|---|---|---|---|---|---|---|---|
| Address Reg | 374 | — | — | — | — | — | — | — | — | — | — | — | — | — | — | — | — | — | — | — | |
| Hortz Total | 375 | 00 | 37 | 37 | 70 | 70 | 37 | 37 | 70 | 60 | 37 | 70 | 60 | 5B | 60 | 5B | 2D | 2D | 5B | 5B | 8C |
| Hrz Disp End | 375 | 01 | 27 | 27 | 4F | 4F | 27 | 27 | 4F | 4F | 27 | 4F | 4F | 4F | 4F | 4F | 27 | 27 | 4F | 4F | 6B |
| Strt Hrz Blk | 375 | 02 | 2D | 2D | 5C | 5C | 2D | 2D | 59 | 56 | 2D | 56 | 56 | 53 | 56 | 53 | 2B | 2B | 53 | 53 | 70 |
| End Hrz Blk | 375 | 03 | 37 | 37 | 2F | 2F | 37 | 37 | 2D | 3A | 37 | 2D | 1A | 17 | 3A | 37 | 2D | 2D | 37 | 37 | 20 |
| Strt Hrz Retr | 375 | 04 | 31 | 31 | 5F | 5F | 30 | 30 | 5E | 51 | 30 | 5E | 50 | 50 | 50 | 52 | 28 | 28 | 51 | 51 | 76 |
| End Hrz Retr | 375 | 05 | 15 | 15 | 07 | 07 | 14 | 14 | 06 | 60 | 14 | 06 | E0 | BA | 60 | 00 | 6D | 6D | 5B | 5B | 04 |
| Vert Total | 375 | 06 | 04 | 04 | 04 | 04 | 04 | 04 | 04 | 70 | 04 | 04 | 70 | 6C | 70 | 6C | 6C | 6C | 6C | 6C | 6C |

TABLE IV-continued

| | | | | | | | | | | | | | | | | | | | | | |
|---|---|---|---|---|---|---|---|---|---|---|---|---|---|---|---|---|---|---|---|---|---|
| Overflow | 375 | 07 | 11 | 11 | 11 | 11 | 11 | 11 | 11 | 1F | 11 | 11 | 1F | 1F | 1F | 1F | 1F | 1F | 1F | 1F | 1F |
| Preset Row SC | 375 | 08 | 00 | 00 | 00 | 00 | 00 | 00 | 00 | 00 | 00 | 00 | 00 | 00 | 00 | 00 | 00 | 00 | 00 | 00 | 00 |
| Max Scan Line | 375 | 09 | 07 | 07 | 07 | 07 | 01 | 01 | 01 | 0D | 00 | 00 | 00 | 00 | 00 | 00 | 0D | 0D | 0D | 0D | 00 |
| Cursor Start | 375 | 0A | 06 | 06 | 06 | 06 | 00 | 00 | 00 | 0B | 00 | 00 | 00 | 00 | 00 | 00 | 0B | 0B | 0B | 0B | 00 |
| Cursor End | 375 | 0B | 07 | 07 | 07 | 07 | 00 | 00 | 00 | 0C | 00 | 00 | 00 | 00 | 00 | 00 | 0C | 0C | 0C | 0C | 00 |
| Strt Addr Hi | 375 | 0C | — | — | — | — | — | — | — | — | — | — | — | — | — | — | — | — | — | — | 00 |
| Strt Addr Le | 375 | 0D | — | — | — | — | — | — | — | — | — | — | — | — | — | — | — | — | — | — | 00 |

? = B in monochrome modes
? = D in color modes
*Values for these modes when the IBM Enhanced Color Display is attached
*Values for these modes when greater than 64K Graphics Memory is installed

CRT Controller Registers (2 of 2)

| Register | | | Mode of Operation | | | | | | | | | | | | | | | | | |
|---|---|---|---|---|---|---|---|---|---|---|---|---|---|---|---|---|---|---|---|---|
| Name | Part | Index | 0 | 1 | 2 | 3 | 4 | 5 | 6 | 7 | D | E | F | 10 | F* | 10* | 0* | 1* | 2* | 3* | |
| Cursor LC Hi | 375 | 0E | — | — | — | — | — | — | — | — | — | — | — | — | — | — | — | — | — | — | |
| Cursor LC Low | 375 | 0F | — | — | — | — | — | — | — | — | — | — | — | — | — | — | — | — | — | — | |
| Wt Retr Strt | 375 | 10 | E1 | E1 | E1 | E1 | E1 | E1 | E0 | 5E | E1 | E0 | 5E | 5E | 5E | 5E | 5E | 5E | 5E | 5E | 5E |
| Light Pen Hi | 375 | 10 | — | — | — | — | — | — | — | — | — | — | — | — | — | — | — | — | — | — | |
| Vert Retr End | 375 | 11 | 24 | 24 | 24 | 24 | 24 | 24 | 23 | 2E | 24 | 23 | 2E | 2B | 2E | 2B | 2B | 2B | 2B | 2B | AB |
| Light Pen Low | 375 | 11 | — | — | — | — | — | — | — | — | — | — | — | — | — | — | — | — | — | — | |
| Vrt Disp End | 375 | 12 | C7 | C7 | C7 | C7 | C7 | C7 | C7 | 5D | C7 | C7 | 5D | 5D | 5D | 5D | 5D | 5D | 5D | 5D | 5D |
| Offset | 375 | 13 | 14 | 14 | 28 | 28 | 14 | 14 | 28 | 28 | 14 | 28 | 14 | 14 | 28 | 28 | 14 | 14 | 28 | 28 | 1D |
| Underline Loc | 375 | 14 | 08 | 08 | 08 | 08 | 00 | 00 | 00 | 0D | 00 | 00 | 0D | 0F | 0D | 0F | 0F | 0F | 0F | 0F | 1F |
| Strt Vert Blk | 375 | 15 | E0 | E0 | E0 | E0 | E0 | E0 | DF | 5E | E0 | DF | 5E | 5F | 5E | 5F | 5E | 5E | 5E | 5E | 5F |
| End Vert Blk | 375 | 16 | F0 | F0 | F0 | F0 | F0 | F0 | EF | 6E | F0 | EF | 6E | 0A | 6E | 0A | 0A | 0A | 0A | 0A | EA |
| Mode Control | 375 | 17 | A3 | A3 | A3 | A3 | A2 | A2 | C2 | A3 | E3 | E3 | 8B | 8B | E3 | E3 | A3 | A3 | A3 | A3 | A3 |
| Line Compare | 375 | 18 | FF | FF | FF | FF | FF | FF | FF | FF | FF | FF | FF | FF | FF | FF | FF | FF | FF | FF | FF |

? = B in monochrome modes
? = D in color modes
*Values for these modes when the IBM Enhanced Color Display is attached
*Values for these modes when greater than 64K Graphics Memory is installed

Attribute Registers (1 of 2)

| Register | | | Mode of Operation | | | | | | | | | | | | | | | | | |
|---|---|---|---|---|---|---|---|---|---|---|---|---|---|---|---|---|---|---|---|---|
| Name | Part | Index | 0 | 1 | 2 | 3 | 4 | 5 | 6 | 7 | D | E | F | 10 | F* | 10* | 0* | 1* | 2* | 3* | |
| Address | 37A | — | — | — | — | — | — | — | — | — | — | — | — | — | — | — | — | — | — | — | |
| Palette | 3C0 | 00 | 00 | 00 | 00 | 00 | 00 | 00 | 00 | 00 | 00 | 00 | 00 | 00 | 00 | 00 | 00 | 00 | 00 | 00 | 00 |
| Palette | 3C0 | 01 | 01 | 01 | 01 | 01 | 13 | 13 | 17 | 08 | 01 | 01 | 08 | 01 | 08 | 01 | 01 | 01 | 01 | 01 | 01 |
| Palette | 3C0 | 02 | 02 | 02 | 02 | 02 | 15 | 15 | 17 | 08 | 02 | 02 | 00 | 00 | 00 | 02 | 02 | 02 | 02 | 02 | 02 |
| Palette | 3C0 | 03 | 03 | 03 | 03 | 03 | 17 | 17 | 17 | 08 | 03 | 03 | 00 | 00 | 00 | 03 | 03 | 03 | 03 | 03 | 03 |
| Palette | 3C0 | 04 | 04 | 04 | 04 | 04 | 02 | 02 | 17 | 08 | 04 | 04 | 18 | 04 | 18 | 04 | 04 | 04 | 04 | 04 | 04 |
| Palette | 3C0 | 05 | 05 | 05 | 05 | 05 | 04 | 04 | 17 | 08 | 05 | 05 | 18 | 07 | 18 | 05 | 05 | 05 | 05 | 05 | 05 |
| Palette | 3C0 | 06 | 06 | 06 | 06 | 06 | 06 | 06 | 17 | 08 | 06 | 06 | 00 | 00 | 00 | 06 | 14 | 14 | 14 | 14 | 06 |
| Palette | 3C0 | 07 | 07 | 07 | 07 | 07 | 07 | 07 | 17 | 08 | 07 | 07 | 00 | 00 | 00 | 07 | 07 | 07 | 07 | 07 | 07 |
| Palette | 3C0 | 08 | 10 | 10 | 10 | 10 | 10 | 10 | 17 | 10 | 10 | 10 | 00 | 00 | 00 | 38 | 38 | 38 | 38 | 38 | 08 |
| Palette | 3C0 | 09 | 11 | 11 | 11 | 11 | 11 | 11 | 17 | 18 | 11 | 11 | 08 | 01 | 08 | 39 | 39 | 39 | 39 | 39 | 09 |
| Palette | 3C0 | 0A | 12 | 12 | 12 | 12 | 12 | 12 | 17 | 18 | 12 | 12 | 00 | 00 | 00 | 3A | 3A | 3A | 3A | 3A | 0A |
| Palette | 3C0 | 0B | 13 | 13 | 13 | 13 | 13 | 13 | 17 | 18 | 13 | 13 | 00 | 00 | 00 | 3B | 3B | 3B | 3B | 3B | 0B |

? = B in monochrome modes
? = D in color modes
*Values for these modes when the IBM Enhanced Color Display is attached
*Values for these modes when greater than 64K Graphics Memory is installed TABLE IV-continued

| Register | | | Attribute Registers (2 of 2) Mode of Operation | | | | | | | | | | | | | | | | | |
|---|---|---|---|---|---|---|---|---|---|---|---|---|---|---|---|---|---|---|---|---|
| Name | Part | Index | 0 | 1 | 2 | 3 | 4 | 5 | 6 | 7 | D | E | F | 10 | F* | 10* | 0* | 1* | 2* | 3* |
| Palette | 3C0 | 0C | 14 | 14 | 14 | 14 | 14 | 14 | 17 | 18 | 14 | 14 | 00 | 04 | 00 | 3C | 3C | 3C | 3C | 3C | 0C |
| Palette | 3C0 | 0D | 15 | 15 | 15 | 15 | 15 | 15 | 17 | 18 | 15 | 15 | 18 | 07 | 18 | 3D | 3D | 3D | 3D | 3D | 0D |
| Palette | 3C0 | 0E | 16 | 16 | 16 | 16 | 16 | 16 | 17 | 18 | 16 | 16 | 00 | 00 | 00 | 3E | 3E | 3E | 3E | 3E | 0E |
| Palette | 3C0 | 0F | 17 | 17 | 17 | 17 | 17 | 17 | 18 | 17 | 17 | 00 | 00 | 00 | 3F | 3F | 3F | 3F | 3F | 3F | 0F |
| Mode Control | 3C0 | 10 | 06 | 06 | 06 | 06 | 01 | 01 | 01 | 0E | 01 | 01 | 0B | 0B | 0B | 01 | 0B | 0B | 0B | 0B | 01 |
| Overscan | 3C0 | 11 | 00 | 00 | 00 | 00 | 00 | 00 | 00 | 00 | 00 | 00 | 00 | 00 | 00 | 00 | 00 | 00 | 00 | 00 | 00 |
| Color Plane | 3C0 | 12 | 0F | 0F | 0F | 0F | 03 | 03 | 01 | 0F | 0F | 0F | 05 | 05 | 05 | 0F | 0F | 0F | 0F | 0F | 0F |
| Hrz Panning | 3C0 | 13 | 00 | 00 | 00 | 00 | 00 | 00 | 00 | 00 | 00 | 00 | 00 | 00 | 00 | 00 | 00 | 00 | 00 | 00 | 00 |

*Values for these modes when the IBM Enhanced Color Display is attached
*Values for these modes when greater than 64K Graphics Memory is installed In text mode, attributes controller 68 generates the video data stream from the font pattern and attribute code. Sequencer 64 generates the timing signals for the other modules in the graphics control circuit and the memory control signals for display memory 72. CRT controller 66 generates all of the sync and timing signals for the monitor and also generates the multiplexed display memory row and column addresses for display refresh and CPU access to display memory 72.

Each of the modules in the Enhanced Graphics controller 56 contains registers which can be programmed with predetermined values to configure controller 56 in a particular state, or video mode. The programming of these registers is performed by software executing on the computer's cpu, usually with the assistance of the BIOS software stored in BIOS ROM (60, FIG. 3). The registers are programmed through I/O ports accessible thru the cpu's I/O address space. The precise method of addressing each register is described in the Chips and Technologies data sheet referenced hereinabove.

The video mode determines (1) the type of monitor which can be used for the display; (2) whether text or all points addressable (APA) graphics is generated; (3) the resolution of the display; (4) the number of colors in the display (5) the amount of display memory; and (6) the mapping of the display memory into the cpu address space. Although the function of each register (and the effect of individual bit values) is known, there are a very large number of possible combinations of register settings, and only a limited number of these combinations are known to produce predictable and useful results. Table IV shows the register settings for these known modes. There are 18 known video modes, but the available modes are limited by the type of monitor and amount of memory available. For graphics modes, the maximum resolution heretofore available is 640×350 in either 16 colors (with 128 K or more of memory) or 4 colors (with 64 k memory). The invention discloses a new technique for configuring an EGA-compatible adapter to produce a new graphics mode for generating 2 2-bit pixels per dot clock cycle. This is accomplished by programming the registers with a new combination of values (described in detail below) which has not previously been known to produce useful results.

Because a standard EGA compatible adapter is used, the ability to configure the circuit in any of the other previously known modes, and thus to run existing software, is not affected. Moreover, when the EGA adapter is configured as described herein, a large body of software which has been written for one of the known modes will execute (with minor changes) with high resolution in the new mode.

The video mode determines how software executing on the cpu views the video memory. In general, the video memory is addressed as an extension of the memory associated with the cpu. The address and organization of the video memory, as seen by the software, varies with the video mode and is critical to proper operation of the software.

The video memory of an EGA is physically organized into 4 planes. In this embodiment, the video memory comprises 8 64 k×4 DRAM chips, with each plane comprising 2 of these memory chips. Each plane is a 64 k×8 memory space, where an access to a single address reads or writes an 8-bit value (a byte). The total memory space is 256 k bytes. (Some EGA systems have only 64 k bytes of memory, organized into 4 planes of 16 k bytes each.) All 4 planes are accessed during a CRT read, using a single memory address to access 4 bytes. Similarly, all 4 planes can be accessed during a CPU read/write cycle.

Figure 7:
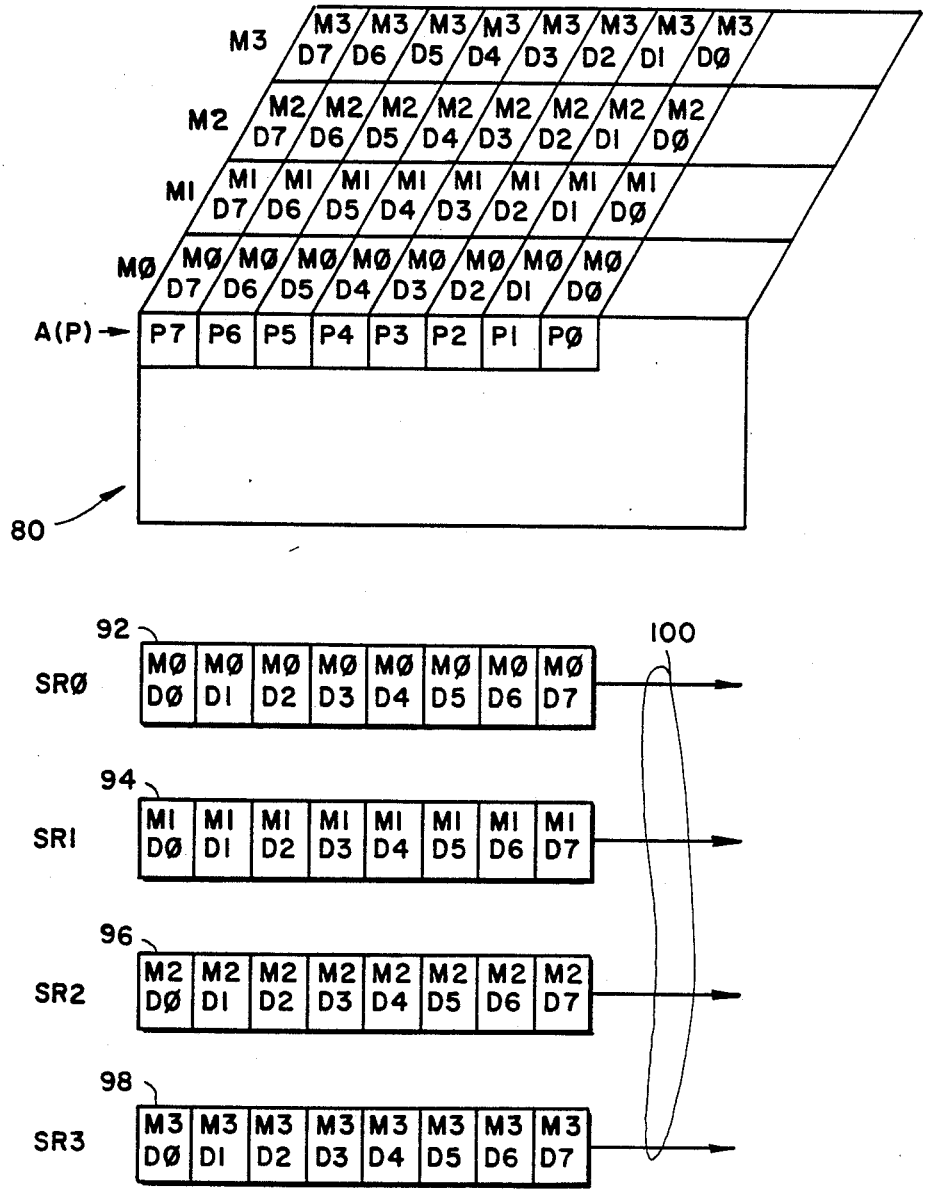
PRIOR ART FIG. 7.
FIG. 7 is a representation of the memory mapping and shift register format in 16 color modes.

In 16 color graphics modes, (modes D,E,10, F Table IV) the physical organization of memory into 4 planes corresponds to the logical view of memory as seen by the cpu. This view is illustrated in FIG. 7. All 4 planes (M0–M3) occupy the same processor address space. A single cpu address A(P) refers to a byte of 8 pixels (P0–P7). Each pixel Pn has a "depth" of 4 bits (M0Dn–M3Dn, one bit in each plane), where the value of these 4 bits determines the color of that pixel (for 16 possible colors). Each plane is referred to as a color plane. The cpu cannot directly address individual bits of the 4 bit color, because they are all at the same cpu address; instead, color is manipulated indirectly thru register settings. The video memory address "window" 80 seen by the processor is thus a bit-map with each bit corresponding to a screen pixel, independent of the color of that pixel. The maximum possible resolution is determined by the size of this window, which is equal to the size of a single plane. Thus the 64 k-byte planes of this embodiment readily support a resolution of 640×350 (640×350=224 k bits=28 k bytes).

As seen in FIG. 7, this memory organization facilitates the access to memory from the display side. A single access to all 4 planes loads 4 8 bit shift registers SR0 92, SR1 94, SR2 96, SR3 98 with the data for displaying 8 4-bit pixels. One pixel per dot clock is shifted out of the shift registers as 4 parallel bits 100 (one from each plane). These 4 bits are sent to the attributes control module where the pixel bit pattern selects one of 16 color registers. Each color register contains a 6 bit color code. The 6 bits from the selected register are sent to the video driver where they are converted to an appropriate signal to drive the monitor. In this embodiment, all six lines are sent to the monitor as parallel inputs. (In other embodiments, the video driver may create a composite video signal on an RF carrier).

The 16 6-bit color registers in the Attributes module are programmable to select the 16 colors to be displayed on the screen (out of the 64 possible combinations which can be formed from 6 bits). The 4 bit pixel bit pattern stored in the display memory for each pixel serves as an index to select one of these 16 registers, which are collectively referred to as the palette.

The maximum rate at which pixels can be provided to the display system in this mode (or any of the modes known in the prior art) is thus determined by the dot clock. One 4 -bit pixel is sent per dot clock cycle. (In mode D, the dot clock is half the frequency of the input clock.)

The above illustrates the operation of the EGA in the 16 color modes in which a maximum resolution of 640×350 is produced. An illustration of the 4 color, 640×350 resolution mode (modes F, 10) will be provided before illustrating the new, 4 color 1280×350 resolution mode.

Figure 8:
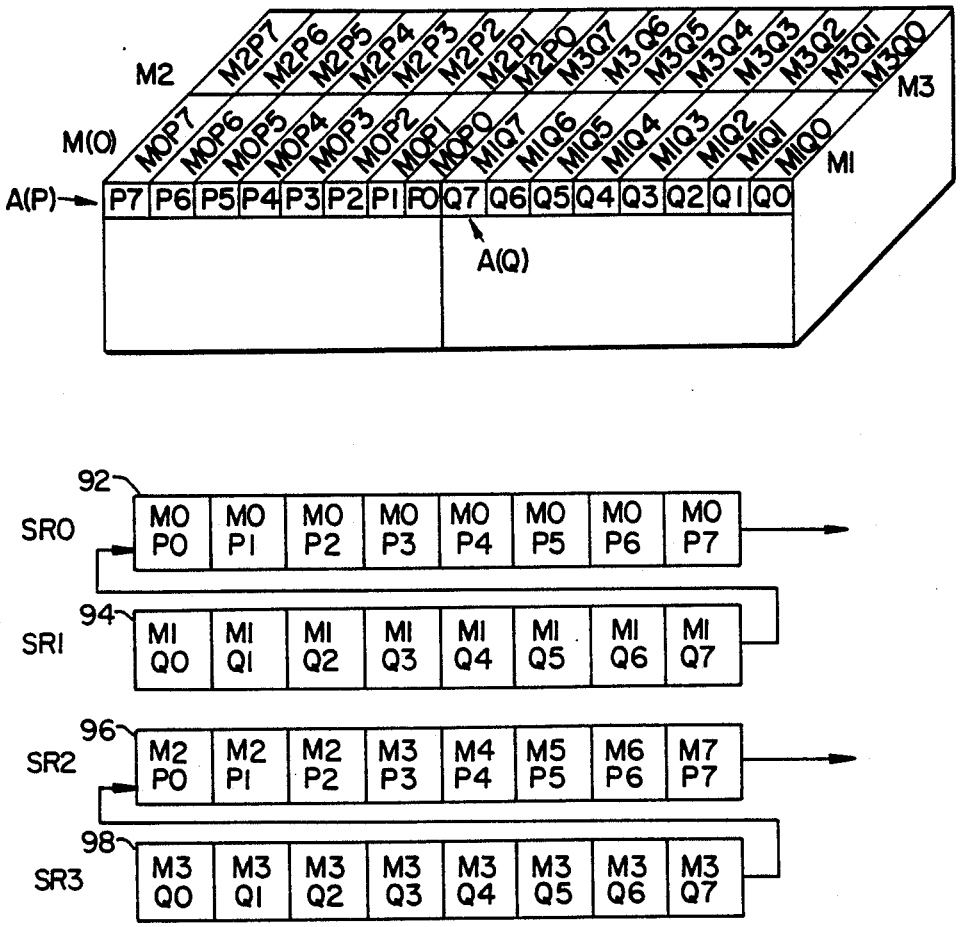
FIG. 8. PRIOR ART
FIG. 8 is a representation of the memory mapping and shift register format in 4-color chain modes.

When there is only 64 K of display memory, the 4 plane memory organization provides a window of only 16 Kb to the software. This is insufficient for a display of 640×350 (224 K bits=28 K bytes). A different view of memory is therefore provided to the software, as shown in FIG. 8. By "chaining" pairs of physical planes, two logical planes instead of four are provided, effectively increasing the window to 32 Kb. Since the memory is still physically organized in 4 planes, the EGA registers are programmed to logically chain plane M1 to plane M0 and plane M3 to plane M2. When a memory address is received from the cpu, it is decoded as follows: (1) even addresses (low order bit equals zero) select planes MO and plane M2; (2) odd addresses (low order address bit equals one) select planes M1 and M3. In either case, the high order address bit replaces the low order address bit and is thereafter ignored. This address decoding technique doubles the range of addresses which the cpu can issue to the video memory (by adding one high order bit to the cpu address) and stores consecutive (adjacent) bytes at the same physical memory address (although in different planes). In FIG. 8, bytes P and Q are shown. As seen by the processor, A(P) and A(Q) are consecutive addresses. Physically, and as seen from the display monitor side, A(P)=A(Q). During CRT read cycles all 4 planes are accessed and 4 bytes placed into the shift registers in the same format as in 16 color modes as shown. When the bits are shifted out of the shift registers, only the bits from shift registers SR0 and SR2 are used by the attributes module to determine the color; the other two bits are forced to zero (by programming bits 1 and 3 in the color plane enable register to zero) before accessing the palette registers. The first 16 bits shifted out define pixels PQ–P7. As the bits are shifted out of the even registers SR0 92 and SR2 96, the bits from odd registers SR1 94 and SR3 98 are shifted in. The registers are not reloaded after 8 dot clocks, and the bits from the odd planes (M1 and M3) are shifted out during the next 8 dot clocks. These are the 16 bits which define the next 8 pixels, Q0–Q7 as viewed by the cpu.

This mode is called chain mode and produces a display of 640×350 with 4 colors, using only 64 Kb of video memory. This mode also generates one pixel per dot clock.

Figure 9:
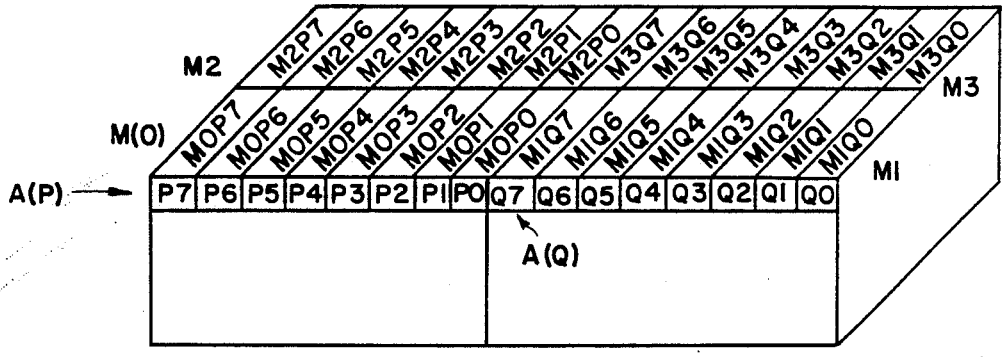
FIG. 9 is a representation of the memory mapping and shift register format in the new 4-color high resolution modes
Figure 9:
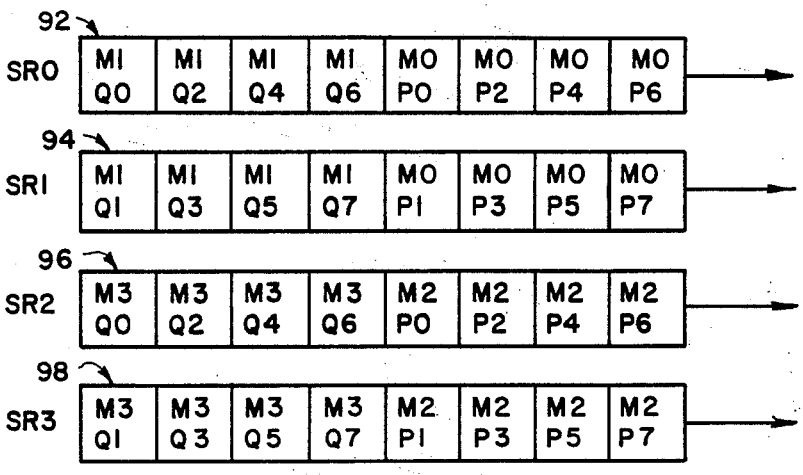

The method of programming the EGA to configure it in a new high resolution mode will now be described. FIG. 9 illustrates the logical memory organization of the high resolution mode. The odd/even chaining of planes is used, but the shift registers are formatted differently and loaded more frequently (every 8 dot clocks) than in chain mode. Even numbered bits from planes M0 and M1 are loaded into shift register SR0 92. Even numbered bits from planes M2 and M3 are loaded into shift register SR2 96. Odd numbered bits from plane M0 and M1 are loaded into shift register SR1 94. Odd numbered bits from planes M2 and M3 are loaded into shift register SR3 98. All of the bits which define adjacent pixels (e.g., P7, P6) are loaded into different shift registers. These bits are shifted out together in one dot clock cycle. In the first dot clock cycle, bits M0P6, M0P7, M2P6, and M2P7 are shifted out. These are all of the bits for pixels P6 and P7. In 4 dot clocks, the bits for the 8 pixels P0–P7 are shifted out. In the next 4 dot clocks, the bits for the 8 pixels Q0–Q7 are shifted out. The bits from all 4 planes are shifted out in 8 dot clocks to generate 16 pixels of 2 bits each in 8 dot clocks. 256 Kb of video memory is used. The window to the processor is 128 Kb.

The far-right column of Table IV shows the register values used to initialize the EGA to configure it in the high resolution mode. The manner of addressing the various registers is described in detail in the Chips and Technologies data sheet referenced hereinabove. The critical register settings are described below; the others may be set as shown in Table IV or as desired.

Miscellaneous output register

Bits 3 and 2 are set to 1 and 0 respectively to select an external clock source. This selects the ext osc input (FIG. 3) so that the high frequency clock divided by 2 is used as the basic dot clock for the EGA.

Bit 4 is set to one. This causes the "INTERNL" signal input to the companion module (FIG. 2) to go high to indicate to the companion module that the high resolution mode is in effect. This provides software control over the state of the companion module.

Sequencer Registers

1. Sequencer Clocking Mode Register

Bit 0 is set to 1 to generate character clocks which are 8 dot clocks wide. This is standard for graphics modes. Bit 1 is set to 0 for high memory bandwidth for the CRT/memory accesses. This is required for horizontal resolution of 640 pixels or more. Bit 2 is set to 0 so that the shift registers (display serializers) are loaded once every character clock. (In chain modes F, 10, this bit is set to 1.) Bit 3 is set to 0 to select the master clock as the dot clock. Bit 4 set to one to set the cpu memory bandwidth for high frequency (25 mhz) operation.

2. Plane Mask Register

Bits 0–3 are all set to one to enable all 4 planes for CPU access.

3. Sequencer Memory Mode Register

Bit 0 is set to 0 for graphics modes. Bit 1 is set to 1 to indicate that 256 Kb of display memory is present. Bit 2 is set to 0 to put the sequencer in odd/even mode. In odd/even mode, even processor addresses access planes 0 and 2. Odd processor addresses access planes 1 and 3.

Attributes Controller Registers

1. Palette Registers

The Attributes Controller normally provides a palette of 16 6 bit registers. In the new, high resolution mode, the 4 low order bits of these registers are programmed to match the register index value and thereby pass thru the 4 bit input value. Thus palette register 1 is programmed to 0001, register 2 is set to 0010, etc. In this hires mode the 4 bits do not represent a single pixel, but in fact represent 2 pixels to 2 bits each. The translation of these bits into colors is thus postponed until after the pixels are serialized. The 4 low order bits are translated by the companion module (inputs 36, FIG. 2). The high order bits 4 and 5 in the color registers are used by the companion module (inputs 42, FIG. 2) to select one of the 4 4-color sets from which bits 0–3 will select a single color. These upper 2 bits may be all set to the same value, or may be set to other values. The latter case can be used to produce a display of 16 colors, where the color representation of a given value of a pixel in memory will actually depend on the value of the adjacent pixel.

2. Attributes Mode Control Register

Bit 0 is set to 1 to select graphics mode. Bit 3 is set to 0 to disable blinking.

3. Color Plane Enable Register

All 4 planes are enabled by setting bits 0–3 to 1. All 4 bits are used by the Attributes module.

Graphics Controller Registers

1. Set/Reset, Enable Set/Reset, Color Compare, and Color Don't Care Registers

Generally, in these registers, bit 0 should equal bit 1 and bit 2 should equal bit 3 for predictable results. These registers control the color settings of pixels as viewed by the cpu. Bits 0–3 refer to the 4 color planes. In odd-/even modes, planes 0 and 1 refer to the same color bit for different pixels, and planes 2 and 3 refer to the other color bit for different pixels.

2. Read Map Select Register

Bits 0,1, and 2 in this register are set to either 000 (select map 0) or 010 (select map 2). The selection determines which plane is read by the processor in read mode 0. In odd/even addressing mode, map 0 selects the 0/1 plane combination (plane 0 for even processor addresses and plane 1 for odd processor addresses). Map 2 selects the 2/3 plane combination (plane 2 for even addresses and plane 3 for odd addresses.)

3. Graphics Mode Register

Bit 4 is set to 1 to select odd/even addressing mode, as described above with reference to the sequencer registers.

Bit 5 is set to 1. Bit 5 selects the format of the video data in the display serializers (shift registers). For most known modes, this bit is set to zero and the shift registers are formatted as shown and described above with reference to FIGS. 7 and 8. Only modes 4 and 5 (Table IV) set this bit to 1 (hex "30"=0011 0000 in Graphics Mode Register). When this bit is set to 1, the registers are formatted as shown in FIG. 9. Even numbered bits from planes M0 and M1 are loaded into shift register SR0. Even numbered bits from planes M2 and M3 are loaded into shift register SR2. Odd numbered bits from plane M0 and M1 are loaded into shift register SR1. Odd numbered bits from planes M2 and M3 are loaded into shift register SR3.

Figure 10:
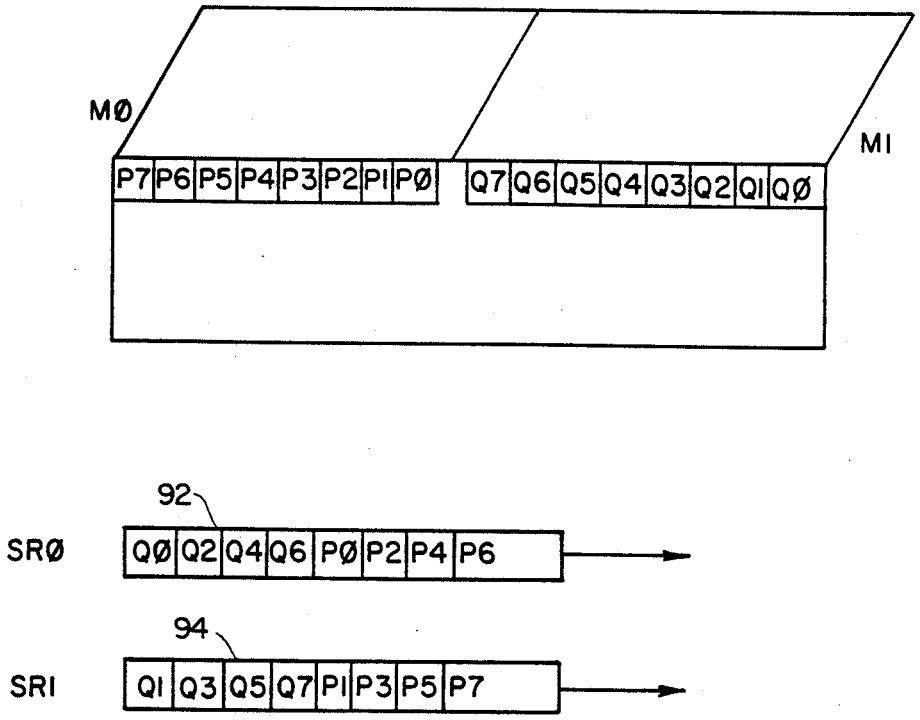
PRIOR ART FIG. 10.
FIG. 10 is a representation of the memory mapping and shift register format in the 4-color CGA modes.

In modes 4 and 5, this shift register format is used to provide 4-color CGA emulation. The memory mapping model of the 4-color CGA emulation is shown in FIG. 10. Planes M0 and M1 are chained and planes M2 and M3 are ignored. In 4-color CGA mode, two adjacent bits define a pixel of one of 4 possible colors. The mapping of video memory into cpu memory is direct; that is, a 2 bit pixel occupies two adjacent bits in cpu memory and in video memory. The software views a byte (8 bits) as 4 pixels, without the "depth" dimension that is characteristic of EGA modes. In effect, there is only one plane (planes M0 and M1 chained together). The shift registers are loaded as shown. When bits are shifted out of the shift registers, only the bits in SR0 and SR1 are actually used. The bits that are shifted out of SR0 and SR1 are the 2 adjacent bits that define a pixel . . . e.g., bits P6/P7, then P4/P5, P2/P3,P0/P1 (all from plane M0) then Q6/Q7,Q4/Q5,Q2/Q3, and Q0/Q1 (all from plane M1). In 8 dot clocks 8 2-bit pixels are shifted out in the proper sequence and in parallel pairs.

As can be seen from Table IV, in CGA modes 4 and 5, the following register settings are combined with the "hex 30" setting of the Graphics Mode Register:

(a) Miscellaneous Graphics Controller Register is "FF"; 11 in bits 2 and 3 maps the display memory into processor memory at locations B8000h-BFFFFh for CGA emulation.

(b) Sequencer-Clock Mode Register: (i) bit 3=1 causes the master clock to be divided by 2 to generate the dot clock. The bits in the shift registers are therefore shifted out at the rate of 1 bit every 2 input clocks and the registers are loaded every 16 input clocks; (ii) bit 1=1 sets the CRT bandwidth for low resolution modes.

(c) Sequencer-Map Mask Register is set to 03h. Only planes 0 and 1 are enabled.

(d) Attributes-Color Plane Enable Register is set to 03-only planes 0 and 1 are enabled. The bits from the other planes are forced to 0 as they are shifted out of shift registers SR2 and SR3.

According to the invention, the shift register format which has heretofore only been used for these CGA compatible modes 4 and 5 is combined with other registers settings, which are much different from those used in CGA modes, to produce a new mode. All 4 planes are enabled; when the bits are shifted out of the shift registers, all 4 parallel bits are used to represent a pair of 2 bit pixels. The software view of memory organization is more similar to the view from "chain modes" (F, 10) (FIG. 8) than to the view from CGA modes (FIG. 10) because of the 2-bit depth. This is advantageous because it means that software written for chain modes can be used in the new, high resolution mode, with it only being necessary to modify the initialization of registers to conform to the new mode settings. But the new mode differs considerably from chain mode by (1) using more than 64 Kb of memory (all 256 Kb is used); thus bit 1 of the Memory mode register of the graphics controller is set to 1 in high resolution mode, 0 in chain modes; (2) loading the shift registers in the format produced by setting bit 5 of the graphics mode register to 1, not 0 as in chain modes; (3) reloading the shift registers every 8 dot clocks, not every 16 as in chain mode (bit 2 of sequencer clocking mode register is 1 in chain mode; (4) using the bits shifted out of all 4 shift registers, not just the 2 registers used in chain mode (bits 0–3 of Attributes color plane enable register).

CRT Controller Registers

In general, the timing registers can be programmed as desired to map the 448,000 (or up to 1,048,576 pixels) pixels into the CRT display. Special considerations apply to the following registers.

1. Mode Control Register.

Bit 6 is set to 0 for word mode. Bit 5 is set to 1 for address wrap at 64 Kb. Bit 3 is set to 0 to increment the memory address counter every character clock. (In chain mode, the memory address counter is incremented every other character clock). If more than 512 scan lines are desired (as set in the vertical total register), then bit 2 should be set to 1 to use the horizontal retrace counter divided by 2 to clock the vertical retrace counter.

2. Offset Register.

This register should be set to the width of the bitmap (in bytes) divided by 4. The width of the bitmap (in bytes) must be a multiple of 4.

3. Maximum Scan Line Register.

This register is set to zero for one scan line per row.

In summary, the invention discloses a new way of programming a graphics adapter to configure it in a new video mode. This new mode differs from previously known modes in that two pixels are generated in each clock cycle. The invention further provides a companion module for serializing the two pixels to generate one pixel per cycle at a frequency of twice the frequency of the graphics adapter system's dot clock. In describing the invention, reference has been made to a preferred embodiment. However, it will be understood by those skilled in the art, and informed by the present disclosure, that changes to this embodiment may be made without departing from the scope of the invention. Accordingly, the scope of the invention is defined not by the preferred embodiment, but is instead defined by the the appended claims.

What is claimed is:

1. A video graphics controller circuit for a digital computer comprising:

a configurable graphics adapter, said adapter having at least two pixel outputs, a plurality of programmable registers for configuring said graphics adapter, a video memory organized into n planes where n is a positive integer, and n shift registers coupled to said video memory for shifting out n bits of data in parallel in a dot clock cycle, said n bits representing two pixels;

dot clock means for generating said dot clock cycle, said dot clock means being coupled to said graphics adapter;

means for programming said programmable registers to configure said graphics adapter to generate two pixels per dot clock cycle at the pixel outputs in a graphics mode;

means coupled to the pixel outputs of said graphics adapter for serializing the two pixels, and for generating a serial stream of pixels at twice the frequency of the dot clock;

wherein said programming means comprises:

means for configuring said graphics adapter to chain alternate memory planes together; and means for configuring said graphics adapter to load all of the bits representing adjacent pixels into different shift registers.

2. A video graphics controller circuit for a digital computer comprising:

an EGA-compatible graphics adapter having at least two pixel outputs, said graphics adapter comprising:

a plurality of programmable registers for configuring said graphics adapter;

a video memory for storing data representing a plurality of pixels, said video memory being organized into n planes, where n is a positive integer,; and n shift registers coupled to said video memory for receiving data stored in said video memory and for shifting out n bits of data in parallel in a dot clock cycle, said n bits representing two pixels;

dot clock means for generating said dot clock cycle, said dot clock means being coupled to said graphics adapter;

means for programming said programmable registers to configure said graphics adapter to generate two pixels per dot clock cycle at the pixel outputs in a graphics mode by chaining alternate memory planes together and by loading all of the bits representing adjacent pixels into different shift registers; and means coupled to the pixel outputs of said graphics adapter for serializing the two pixels, and for generating a serial stream of pixels at twice the frequency of the dot clock.

3. A method of operating a graphics adapter to generate two pixels per clock cycle in an all-points-addressable graphics mode, comprising the steps of:

chaining alternate memory planes;

configuring the graphics adapter to load a plurality of shift registers by loading all of the bits representing a pair of adjacent pixels into different shift registers and by loading each shift register with bits from a pair of chained alternate memory planes;

shifting the bits representing the pair of adjacent pixels out of the registers in one clock cycle; and generating the pair of adjacent pixels at the adapter's output in one clock cycle.

4. The method of claim 3 wherein the chaining step comprises the step of configuring the adapter to store alternate bytes in alternate memory planes.

5. The method of claim 3 wherein the chaining step comprises the step of configuring the adapter to store bytes with even-numbered addresses in even-numbered memory planes and bytes with odd-numbered addresses in odd-numbered memory planes.

6. The method of claim 5 further comprising the steps of:

shifting a byte of bits from even-numbered memory planes out of the shift registers; and thereafter shifting a byte of bits from odd-numbered memory planes out of the shift registers.

7. A circuit for a use with a graphics adapter in a digital computer, said graphics adapter having at least two outputs, and said graphics adapter being configurable to generate two pixels in parallel per dot clock cycle on the two outputs, said circuit comprising:

serializing means having at least two inputs and at least one output for receiving the two pixels generated in parallel by the graphics adapter and converting the two pixels into a serial stream of pixels on its output by generating a first pixel during the first half of the dot clock cycle and a second pixel during the second half of the dot clock cycle;

video line driver means for driving a monitor; and means responsive to an externally-supplied signal for coupling either the output of said serializing means or the outputs of the graphics adapter to said video line driver means.

8. The circuit of claim 7 wherein said video line driver means includes means for assuming a high-impedance state on its outputs.

9. The circuit of claim 8 further comprising:

means coupled to said video line driver means and responsive to externally-supplied signals for causing the outputs of said video line driver to assume a high-impedance state.

10. The circuit of claim 9 wherein said coupling means comprises a first multiplexer.

11. The circuit of claim 10 further comprising:

color translation means having a first input for receiving a color set selection signal and having a second input coupled to said serializing means and an output coupled to said first multiplexer for converting the bits representing each pixel into a signal representing a color from a color set selected by the color set selection signal.

12. The circuit of claim 10 wherein said serializing means comprises a second multiplexer having a select input.

13. The circuit of claim 12 further comprising:

frequency divider means for receiving a first clock signal and for generating a second clock signal, said second clock signal being a square wave having half the frequency of the first clock signal and being coupled to the select input of said second multiplexer.

* * * * *